US011072406B2

(12) United States Patent
Austin et al.

(10) Patent No.: US 11,072,406 B2
(45) **Date of Patent: *Jul. 27, 2021**

(54) SYSTEM FOR THE DEPLOYMENT OF MARINE PAYLOADS

(71) Applicant: Woods Hole Oceanographic Institution, Woods Hole, MA (US)

(72) Inventors: Thomas Austin, Falmouth, MA (US); Michael Purcell, North Falmouth, MA (US); Robin Littlefield, Falmouth, MA (US); Frederic Jaffre, East Falmouth, MA (US); Gwyneth Packard, Bourne, MA (US); Glenn McDonald, Marston Mills, MA (US)

( * ) Notice: Subject to any disclaimer, the term of this patent is extended or adjusted under 35 U.S.C. 154(b) by 87 days.

This patent is subject to a terminal disclaimer.

(21) Appl. No.: 16/135,460

(22) Filed: Sep. 19, 2018

(65) Prior Publication Data

US 2019/0100292 A1 Apr. 4, 2019

Related U.S. Application Data

(63) Continuation-in-part of application No. 15/009,991, filed on Jan. 29, 2016, now Pat. No. 10,112,686.

(51) Int. Cl.

| | |
|---|---|
| ***B63B 1/00*** | (2006.01) |
| ***B63B 5/00*** | (2006.01) |
| ***B63G 8/22*** | (2006.01) |
| ***B63G 8/00*** | (2006.01) |

(Continued)

(52) U.S. Cl.

CPC ..... *B63G 8/22* (2013.01); *B63G 8/001* (2013.01); *B63G 8/33* (2013.01); *B63G 8/42* (2013.01); *B63B 2207/02* (2013.01); *B63B 2211/02* (2013.01); *B63G 2008/004* (2013.01); *B63G 2008/005* (2013.01)

(58) Field of Classification Search

CPC ..... B63G 8/00; B63G 8/001; B63G 8/04; B63G 8/14; B63G 8/22; B63G 2008/001; B63G 2008/002; B63G 8/42; B63G 8/33; B63B 22/003; B63B 22/08; B63B 2022/06; F41F 3/00; F41F 3/10

USPC ..... 114/20.1, 25, 238, 239, 312, 313, 316, 114/317, 318, 319, 320, 321, 322, 324, 114/325, 330, 333; 414/137.1, 137.7, 414/137.8, 143.2

See application file for complete search history.

(56) References Cited

U.S. PATENT DOCUMENTS 1,526,256 A * 2/1925 Techel ..... F41F 3/10 114/238

5,666,900 A * 9/1997 Carroll, III ..... B63G 8/00 114/238

(Continued)

*Primary Examiner* — Daniel V Venne

(74) *Attorney, Agent, or Firm* — Jessica C. Engler; Russel O. Primeaux; Kean Miller LLP

(57) ABSTRACT

The present invention involves a system for the release of low relief, self-orienting deployable payloads from a platform such as a submersible vehicle and a mechanism of passive buoyancy compensation of the vehicle. The system secures one or more payloads by a vacuum force without an additional mechanical restraining mechanism and deployment of a payload is accomplished by disengaging the vacuum hold to release the payload for its intended function. Once deployed, the payload may reorient itself to a functional orientation without additional assistance.

21 Claims, 13 Drawing Sheets

(51) Int. Cl.
*B63G 8/42* (2006.01)
*B63G 8/33* (2006.01)

(56) References Cited

U.S. PATENT DOCUMENTS

| | | | | |
|---|---|---|---|---|
| 6,701,819 | B1 * | 3/2004 | Williams | F41F 3/07 114/238 |
| 7,032,530 | B1 * | 4/2006 | Ansay | B63G 8/28 114/312 |
| 7,232,353 | B1 * | 6/2007 | Gauthier | B63G 8/38 114/318 |
| 7,942,107 | B2 * | 5/2011 | Vosburgh | B63G 8/001 114/312 |
| 8,161,899 | B1 * | 4/2012 | Smallin | F41F 3/10 102/406 |
| 8,171,873 | B2 * | 5/2012 | Woolwright | B63G 8/41 114/322 |
| 9,453,705 | B2 * | 9/2016 | Sylvia | B63G 8/001 |
| 2008/0127878 | A1 * | 6/2008 | Marion | B63G 8/001 114/337 |
| 2015/0175244 | A1 * | 6/2015 | Webster | B63G 8/22 114/331 |
| 2016/0221655 | A1 * | 8/2016 | Austin | B63B 22/003 |

* cited by examiner

800

SYSTEM FOR THE DEPLOYMENT OF MARINE PAYLOADS

CROSS REFERENCE TO RELATED APPLICATIONS AND PUBLICATIONS

This is a continuation-in-part (CIP) application that claims priority to and the benefit of application Ser. No. 15/009,991, now U.S. Pat. No. 10,112,686 issued on Oct. 30, 2018, and U.S. Provisional Patent Application Ser. No. 62/109,994, filed on Jan. 30, 2015, the disclosures of which are hereby incorporated herein by reference in their entirety.

STATEMENT OF RIGHTS TO INVENTIONS MADE UNDER FEDERALLY SPONSORED RESEARCH

This invention was made with U.S. Government support under N00014-08-1-0165 awarded by the Office of Naval Research. The U.S. Government has certain rights in this invention.

FIELD OF THE INVENTION

The present invention relates to the field of marine operations and exploration. Specifically, this invention involves a system for the release of deployable objects from a platform such as an aquatic vehicle without mechanically restraining the deployable object and a mechanism of compensating the buoyancy and fluid displacement of the vehicle without active measures such as pumping ballast.

BACKGROUND OF THE INVENTION

Marine vehicles are used in a wide range of applications including exploration, military practices, and scientific research amongst others. In many applications, these vehicles are entirely or at least partially remotely controlled from another location such as a ship, vessel, or land base and use a plurality of payloads including instruments such as modems, beacons, markers, acoustic transmitters, acoustic transponders, hydrophones, sensors, seismometers, mines, munitions and similar devices. These instruments are often deployed on or above the seafloor or on bottom of a fluid body (for example, a body of water) for purposes of observation and communication, but are also employed for underwater navigation and tracking involving the integration of acoustic network devices with submersible vehicles to track targets and triangulate locations precisely.

One area of oceanographic use that has seen much progress is the art of deploying a torpedo from an aquatic vehicle. As widely known in the art, most torpedo launching systems from submarines and other underwater vehicles have a torpedo inside a torpedo tube. The tube is flooded with water and vented to remove any air pockets, and pressure is equalized between tube and the surround water (referred herein as the fluid environment). Torpedoes are typically launched in one of two ways, either the torpedo activates its propulsion system and swims out or, the system includes a water ram that pushes high pressure water at the rear of the torpedo to eject it out of the tube. Older systems utilized compressed air to push a mechanical launching platform or plate that in turn launches the torpedo. Such systems are no longer used due to the noise created and the possibly of releasing air bubbles during torpedo launch.

In an exemplary launching systems (such as that described in U.S. Pat. No. 5,199,302), two doors are provided for launching a torpedo, a breach door leading into the vehicles interior and a muzzle door or bulkhead, leading to the outside fluid environment. A system with simplified components is needed, especially when building launching systems into smaller, simpler vehicles like AUVs.

Precise navigation during vehicle operation is a fundamental requirement for many underwater missions, and maintaining a steady course and buoyancy level of the submerged vehicle is of significant concern. As a vehicle moves through the water and deploys a payload from the hull, the weight (and density) of the vehicle is reduced and the buoyancy increased. Without a method to immediately compensate this change, the vehicle may shift off course, adding a substantial variable of error to the mission. While methods involving pumping of air of fluid through bladders or gas or bladder release are often used to compensate for buoyancy changes, these methods are unsuited for many operations including clandestine missions where the emission of gas bubbles is highly undesirable. Therefore, a muted or more subtle system and method are needed.

Buoyancy of a floating or submerged object is described in the simplest terms as the force on an object making that object rise upwards. Buoyancy is produced when there is a difference in pressure placed onto an object by fluid (and air when floating at the surface) that the object is in. The net buoyancy force is then the weight of the fluid that the object displaces. Density is defined as mass divided by volume and determines the weight of the object, while the object's volume and the density of the ambient fluid (e.g. ocean water) determines the weight of the displaced fluid. When object's density is less than the density of the displaced fluid, the object has positive buoyancy and it will rise above the ambient fluid. When the reverse is true, the object will sink.

The buoyancy force equation calculates the force acting opposite to gravity that affects all submerged objects. When compared to the force of gravity acting on that object, the overall buoyancy of an object can be calculated. The buoyancy force equation is $F_b=V\times D\times g$, where V is the volume of the submerged object, D is the density of the fluid in which it is submerged, and g is the force of gravity.

The force of gravity (or other downward force) that the object experiences is $F_g=G\times m$, where G is the universal gravitation constant, and m is the object's mass. If the buoyancy force is greater than the forge of gravity, then the object will float. If the reverse is true, the object will sink.

Another aspect of the deployment system is controlling how the deployed payloads are positioned for optimal functional operation. Once the payload has exited the vehicle, it may land in one of many positions on the underlying surface of the fluid body (e.g. the seafloor). To limit additional interaction and adjustment with the vehicle, the payload is required to re-orient and stabilize itself prior to its designated use. In such cases, a self-orienting payload provides the necessary means to complement such a system with a reduced detectable presence in the water. This self-orienting payload must still preserve the ability its ability to form a vacuum within the vehicle's deployment chambers. And in some cases, will be required to reconnect with the vehicle, reinsert into the deployment chamber and re-establish a vacuum.

With the growing emphasis on ocean exploration and navigation, an adaptive system for efficient and low profile payload deployment is highly beneficial to save time and labor costs associated with the use of submersible or water vehicles.

SUMMARY OF THE INVENTION

The present invention describes a deployment system that is integrated into or with the body of an object. The object may comprise a device or vehicle that is submergible or floating on a body of fluid. The integrated, innovative system comprises at least one deployment chamber holding at least one deployable payload that is held in the chamber by a vacuum force. The vacuum force, once established is configured to be broken, independently releasing the one or more payloads to a desired position such as over the floor or the bottom of any fluid body (e.g. the ocean seafloor or the bottom of a reservoir). When the release of the payload is initiated, fluid is allowed to flood the deployment chamber of the instant invention, including, at least in part, the space previously occupied by the one or more payloads. Typically this influx of fluid breaks the vacuum force, removing the only force holding the one or more payloads. The instant invention also enables the object to which it is integrated to maintain a substantially constant buoyancy. This constant buoyancy maintenance, is referred to as the buoyancy compensation mechanism, and is enabled by replacing the payloads density with matching fluid density and thereby compensating (negating) the object's buoyancy change due to payload deployment.

Additionally, the inventive system describes a deployable payload of a suitable weight and dimension to allow the capability of being held solely by the force of a vacuum (i.e., without any additional mechanical restraining mechanism). In other embodiments, the deployable payload is sustainably held by vacuum force. In further embodiments, the deployable payload is held by vacuum force and a mechanical restraint. In many embodiments, these payloads are of a relief such that such objects rest on the fluid-body floor and do not require additional anchoring. Furthermore, the deployable payloads are designed with a time-delayed, self-orienting mechanism to capably allow reorientation and/or self-leveling at the desired submerged position after deployment.

The present invention further describes a submersible system having a suitable weight and volume to maintain a substantially constant buoyancy before and after payload deployment. All floating and submerged objects experience a buoyant force. The submersible system (comprising, the deployment chamber's inner wall, the vacuum mechanism, and the vacuum breaker, and in some embodiments, the offset mechanism) and payload combination has (i.e., experiences) a first buoyant force, while the system after payload release (i.e., the system without the payload, meaning the deployment chamber's inner wall, the vacuum mechanism, and the vacuum breaker) has (i.e. experiences) a second buoyant force. In one embodiment, the first buoyant force is not more than 20 percent different than the second buoyant force (i.e. the second buoyant force does not differ more than 20 percent from the first buoyant force). In an additional embodiment, the measure of the first buoyant force does not exceed the measure of the second buoyant force by more than 20 percent. In a further embodiment, the first buoyant force is not greater than 20 percent greater than the second buoyant force or not 20 percent less than the second buoyant force. In a further embodiment, the first buoyant force is substantially equal to the second buoyant force.

One purpose of this invention is to provide scalable systems and assemblies that may be incorporated into a wide range of objects, including aquatic vehicles such as human-occupied vehicles (HOVs), remote operated vehicles (ROVs), autonomous underwater vehicles (AUVs), unmanned underwater vehicles (UUVs), gliders, towed vehicles, surface crafts, submarines, mini-submarines, boats, vessels, and any other suitable vehicles. It is even envisioned that the system described herein may be utilized in aerial vehicles particularly with the use of the self-orienting payloads.

In some embodiments of the present invention, the system may be used to deploy payloads such as markers, beacons, light devices, or other signaling objects to mark specific locations underwater such that a signaling payload may relay a signal immediately or at a later designated time to another aquatic vehicle, observatory, remote location, or other signaling object or payload. In some circumstances, the signaling payloads may be deployed to mark submerged mines, munitions, or other possible obstructions or hazards. In other cases, signaling payloads may be deployed to mark the location for the future deployment of mine or munitions. In still other cases, signaling payloads may be deployed to form a navigation path (e.g. signaling breadcrumbs). For many operations, the system allows for quiet and potentially silent deployment of payloads for stealth or reconnaissance missions as well as minimalized drifting of the system during deployment with the buoyancy compensation mechanism.

In some embodiments, the inventive system is utilized to deploy submerged signaling devices such as acoustic communication devices, optical communication devices, sensors, robots, actuators, lights, strobes, cameras, or samplers for the establishment of submerged communication networks comprising of submersible vehicles, observatories, modems, as well as a plurality of other communication or observation devices. However, one skilled in the art would immediately recognize other potential uses for the inventive system.

In operation, the vehicle or platform comprising the inventive system moves through the fluid to typically a target position. Upon arrival to the target position, one or more stowed payloads is triggered to release and is deployed from the hull of the vehicle onto the fluid bottom floor or underlying terrain. In concert with the release of the payload, the buoyancy compensation mechanism enables fluid (most often from the external environment) to replace the weight and density lost by the deployed payload, instantly compensating the vehicles' buoyancy without any active measures (e.g. pumping). Consequently, the vehicle experiences minimal or no change in ballast, conserving energy and then continues on to the next destination or objective.

Once deployed, the payload falls and contacts the underlying surface. The leg release mechanism, when present, disengages the leg assembly, allowing the legs to release and pivot from their point of attachment to the payload. The legs then contact the ground and generally push the payload into a substantially upright position or at least a functional position.

DETAILED DESCRIPTION OF THE PREFERRED EMBODIMENTS

Overview.

Figure 6B:
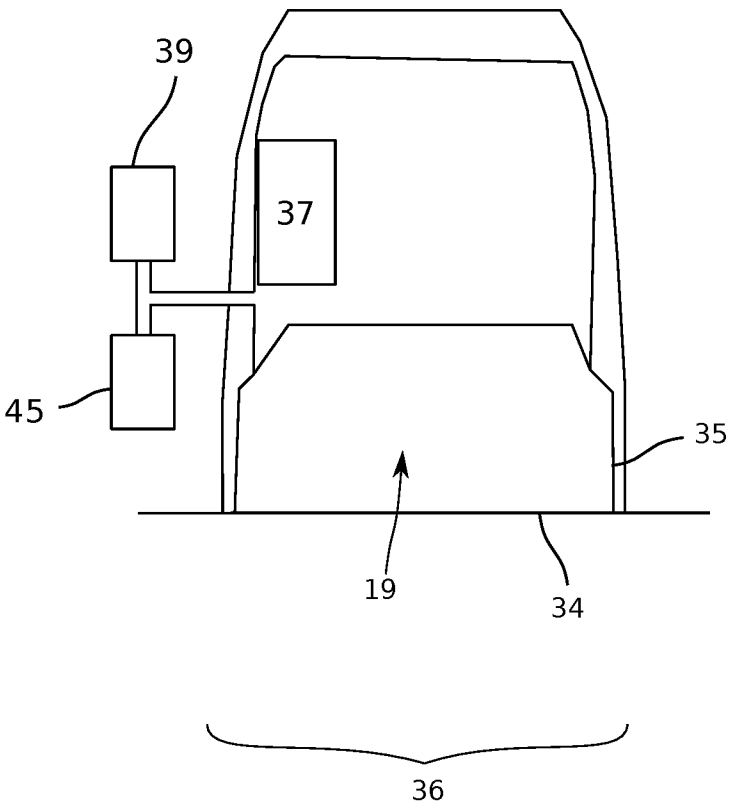
FIG. 6B illustrates the deployment chamber of FIG. 6A loaded with a payload.
Figure 6A:
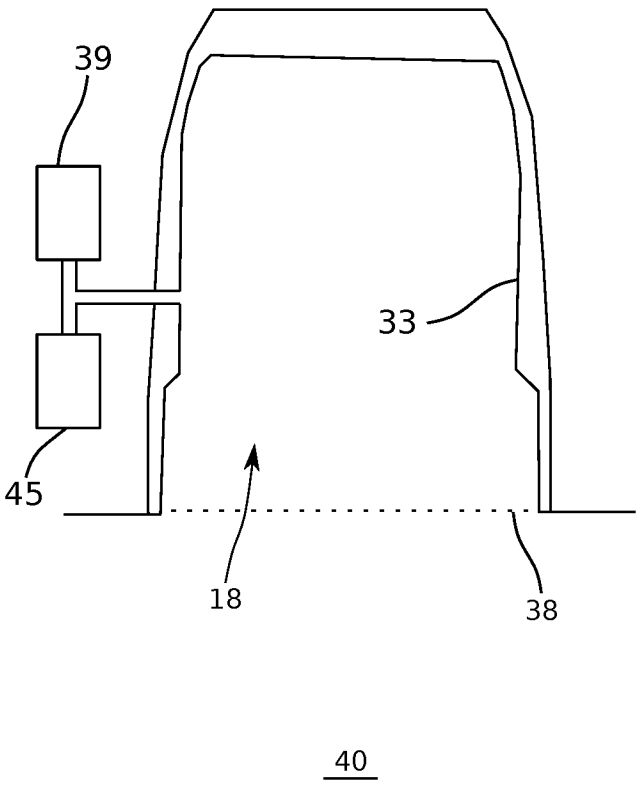
FIG. 6A illustrates one embodiment of the deployment chamber without a loaded payload.

In its simplest form, as illustrated in FIGS. 6A and 6B, the instant invention is chamber or space that either excludes a fluid environment 40 or is incorporated into an object that excludes a fluid environment 40 with an internal void, or space that is not excluded from the fluid environment 40. That internal space is configured to hold a payload and that payload is configured to form a fluid-tight seal 36 between the structure of the chamber and itself. Furthermore, the payload is configured to not fill the entire internal space and that unfilled space can be put under vacuum, due to the fluid-tight seal 36. The chamber is designed in such a manner that the vacuum inside the internal space has enough vacuum force to hold the payload in place without any additional mechanical restraint. Finally, the invention provides vacuum making and breaking mechanism to initiate payload restraint and payload release, respectively.

One embodiment of this invention comprises a system for the submerged (e.g. underwater) release of at least one payload such as beacons, markers, hydrophones, sensors, mines, munitions, communication modules (e.g., acoustic or optical communication nodes), or other devices from an object such as an aquatic vehicle or buoy. In the embodiment shown in FIG. 1, the deployment system 11 is attached to object (here an AUV) 10 enabling the deployment of payloads in a fluid body such as an ocean or lake. This system is distinguished from other systems presently known in the art by its sole use of a vacuum-based retaining mechanism in lieu of a mechanical restraint. The vacuum-based retaining mechanism produces a vacuum force that restrains and enables deployment when removed. In one embodiment, the restraining vacuum is broken through the admittance of activation of actuators and valves to release the retained payload. The inflow of fluid during payload release also provides a simple, efficient and highly effective buoyancy offset mechanisms where the weight of the deployed payload is at least partially compensated by the volume and mass of the vehicle and deployed payload. Such a compensation mechanism and method immediately balances the difference in platform weight and allows the object 10 to continue its course with little to no interruption in direction or speed while conserving energy.

Figure 2:
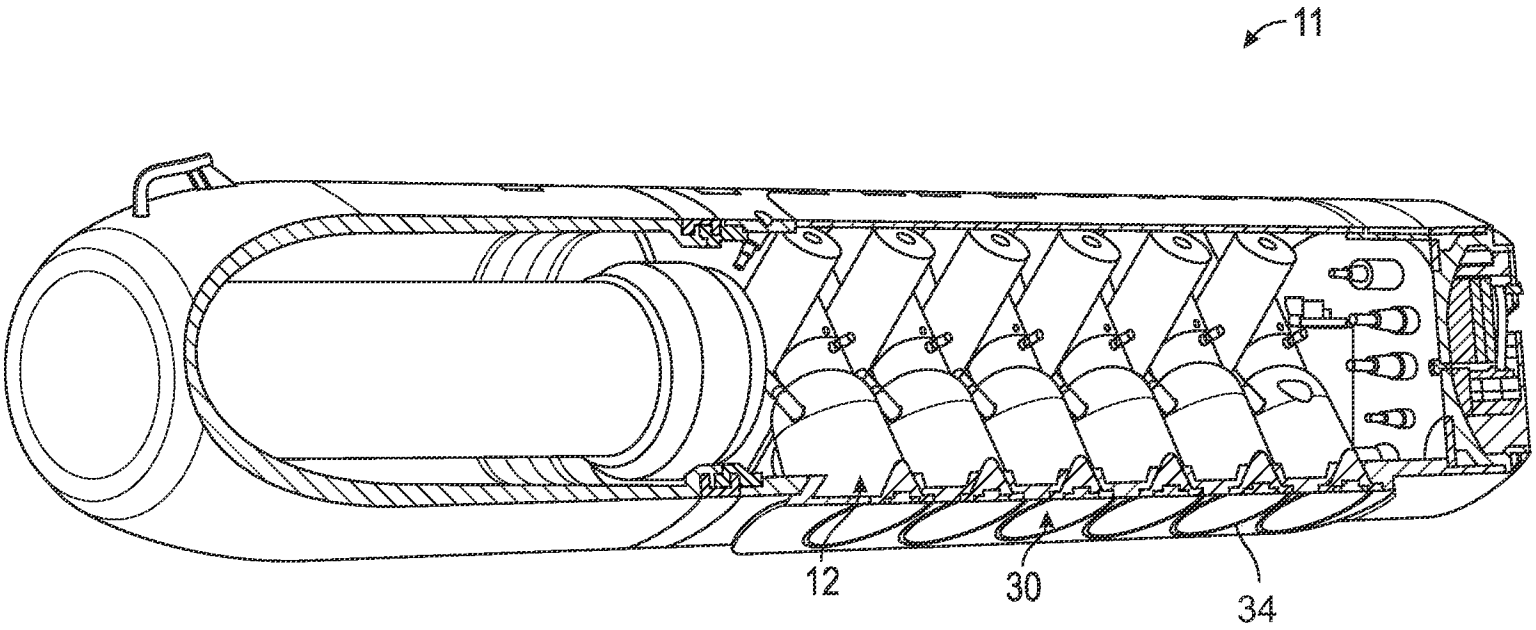
FIG. 2 shows a detailed schematic depicting the internal cavity of the carrier and the contained deployment chambers.
Figure 4A:
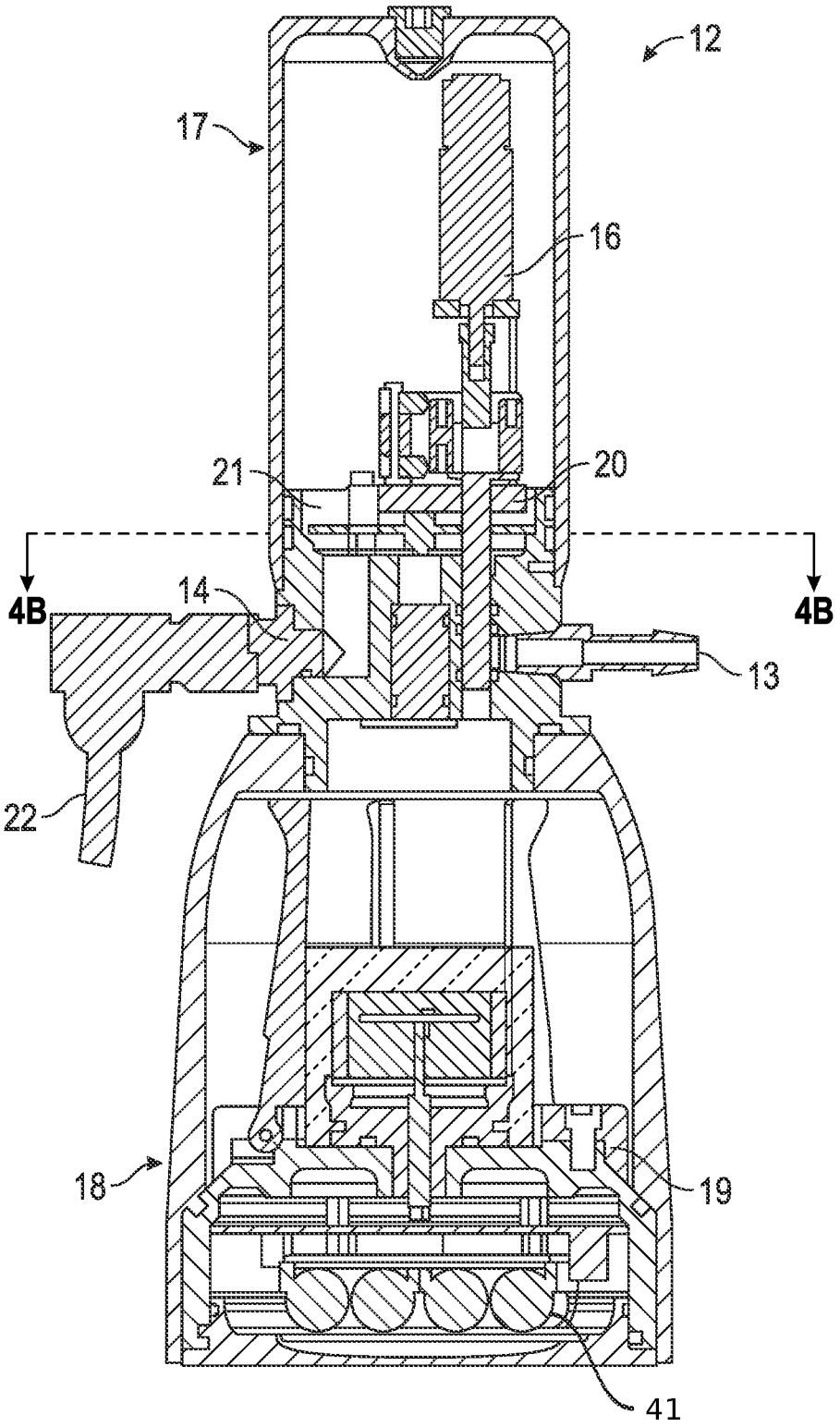
FIG. 4A depicts one embodiment of the internal components of the deployment chamber in a cross-sectional view.

Turning to FIG. 2, in one embodiment, the inventive deployment system 11 comprises a plurality of deployment chambers 12, arrayed in two rows throughout the system. Each deployment chamber 12 comprises an inner wall or surface 33, defining the division between two volumes, the dry space 17 and the wet space 18. The wet space 18 is configured to be open to the external environment; and has no cover or structure for separating the wet space 18 with the external environment. At least one payload 19 resides inside the deployment chamber's wet space 18 and surface 34 of payload 19 can be seen in FIG. 2, the at least one payload's 19 base 34 further comprising a sealing zone 35. The sealing zone is defined as at least the base 34 of the payload that forms a gas- and fluid-tight seal with a portion of the inner wall 33. FIG. 4A illustrates a second view of the payload-portal arrangement and it can be appreciated that (i) the two components form an air-tight seal and that (ii) no other restraint (other than vacuum force) is used to hold the payload 19 in the deployment chamber 12.

Deployment Chambers

Figure 3:
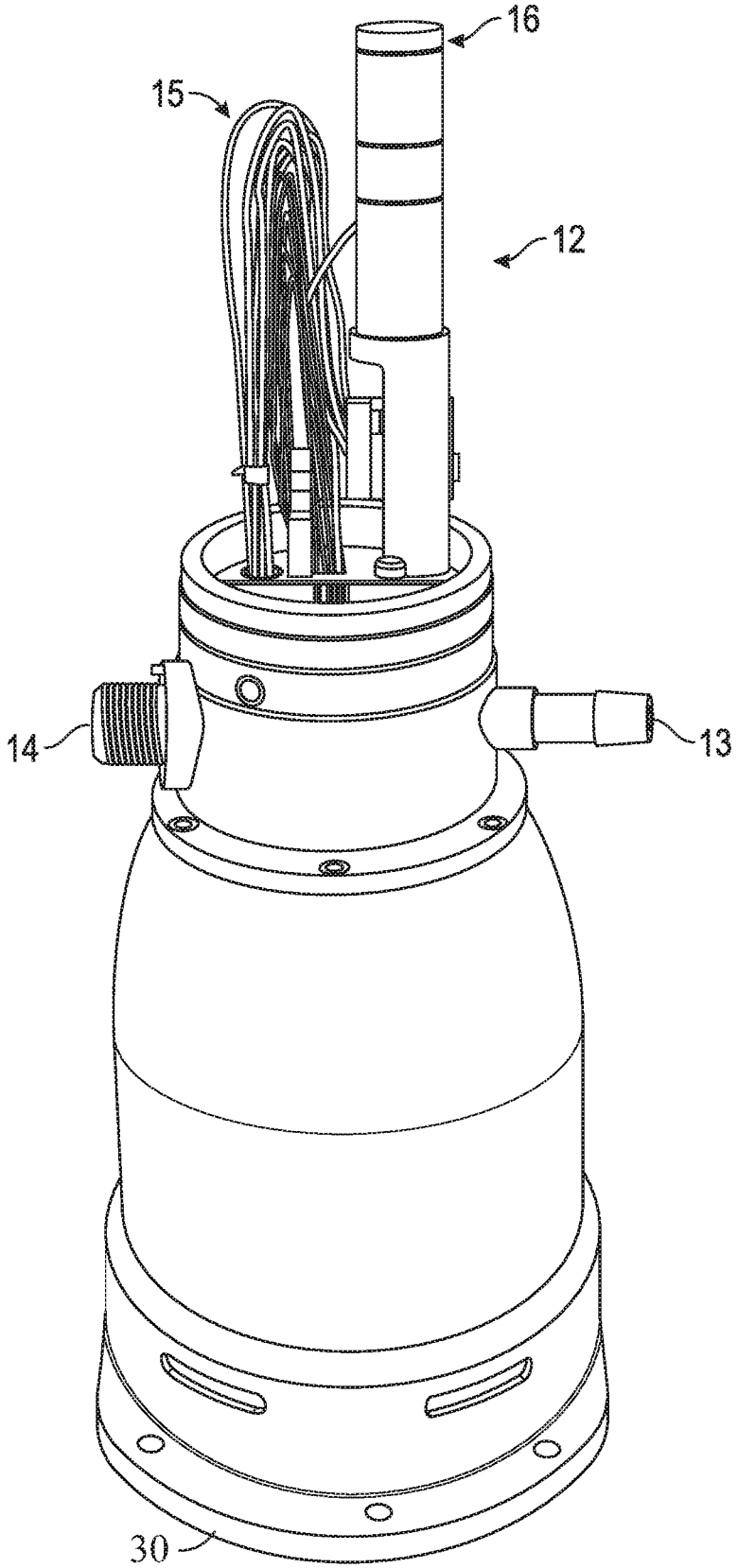
FIG. 3 depicts an external view of the deployment chamber including the electronics and circuitry, the actuator, and the associated ports, according to one embodiment.

Turning to FIGS. 3 and 4A, an embodiment of the exterior of a single deployment chamber is illustrated. In one embodiment, the deployment chamber is divided into three compartments: the physical container or exterior; the dry space 17; and the wet space 18. The container defines the deployment chamber and interior to it comprises an inner wall 33, separating the dry and wet spaces. The wet space 18 is defined as the area that holds payload 19 and is configured to be exposed to the fluid environment (e.g. is not water-tight without a payload). The dry space 17 comprises the necessary components to establish and release the vacuum force and is configured to be separated from the fluid environment.

In one embodiment, the system 11 comprises at least one deployment chamber. In an additional embodiment, the system 11 comprises a plurality of deployment chambers, arrayed in one or more lines (see. FIG. 2), or in concentric circles. The at least one or plurality of deployment chambers are preferably oriented downward, such that the forces of gravity and buoyancy will pull a released payload out of the deployment chamber; however, those skilled in the art will recognize that the deployment chamber or chambers may face any direction. It will be understood that a single embodiment may comprise one or more deployment chambers, one or more types (configurations or constructions) of deployment chambers and that the shared components residing outside the deployment chambers 12 may be adapted to function with such multiple types of deployment chambers.

In one embodiment, the at least one deployment chamber 12 is a self-contained system comprising all the necessary components, described in more detail below, to receive, hold, and release a payload 19. In another embodiment, the deployment chamber 12, comprises additional components, comprising the shared components residing in the system 11 or the object 10, to at least receive, hold, or release a payload 19. Typical shared components are described separately below, but the other components not explicitly described as shared may be converted to shared components outside the deployment chambers 12.

The wet space 18 comprises at least one payload 19 and a volume which can be held under vacuum when the at least one payload 19 is loaded into the wet space. To better understand the wet space 18 and the novel functions it enables, wet space 18 can be thought of as comprising at least two volumes. The first volume 191 is defined as the space taken up by the payload or payloads and that will displace fluid, if and when fluid is present in the wet space. The first volume 191 extends to the outer surface of payload, and is defined by the payload's sealing zone, which is the maximum sealable volume 38 of the wet space. The surface may extend past the exterior of the system 11, but the maximum sealable volume 38 depends on the contact between sealing zone 35 and inner wall 33. The second volume 192 is defined as the remainder of the wet space that is not taken up by the payload. The second volume may be filled with vacuum, fluid, or a buoyancy compensator 37.

The payload 19 remains held in the wet space 18 until deployment is initiated. Payload 19 is held by vacuum force and the second volume 192 is under vacuum, maintaining that vacuum force on the payload. When deployment is initiated, actuator 16 and actuator switches 21—collectively, the actuation assembly-activate valve 20, allowing inflow of fluid into the wet space 18, negating the vacuum force of the second volume 191. Fluid inflow most often originates from the external environment from an interconnected pipe or access way, as known in the art. The external environment typically is at higher pressure than the vacuumed second volume, and therefore the fluid will inflow passively. After fluid inflow, payload 19 is released and drops, out of the wet space and the system and into the external environment. In one embodiment, the payload leaves the wet space by gravity and (negative) buoyancy, after the vacuum force is removed. In other embodiments, the payload may be self-propelled out of the wet space.

The elimination of mechanical restraints in the instant invention reduces weight and eliminates noise associated with moving parts, thereby making the inventive system advantageous for stealth deployment of submerged objects in clandestine missions or in operations in which require little to no environmental disturbance such as observational research studies.

In an additional embodiments, the system is employed in a less mobile manner such as with a stationary object (e.g., a buoy, a float, an underwater structure, an underwater observatory) disposed at or on the fluid surface, in the fluid column (e.g., ocean water column) above the fluid-body floor (e.g. seafloor), or directly on the fluid-body floor to deploy payloads within the platform's vicinity. In a further additional embodiment, a plurality of systems may be integrated into a plurality of objects (usually one system per object), when necessary to deploy more payloads for a desired operation.

Figure 1:
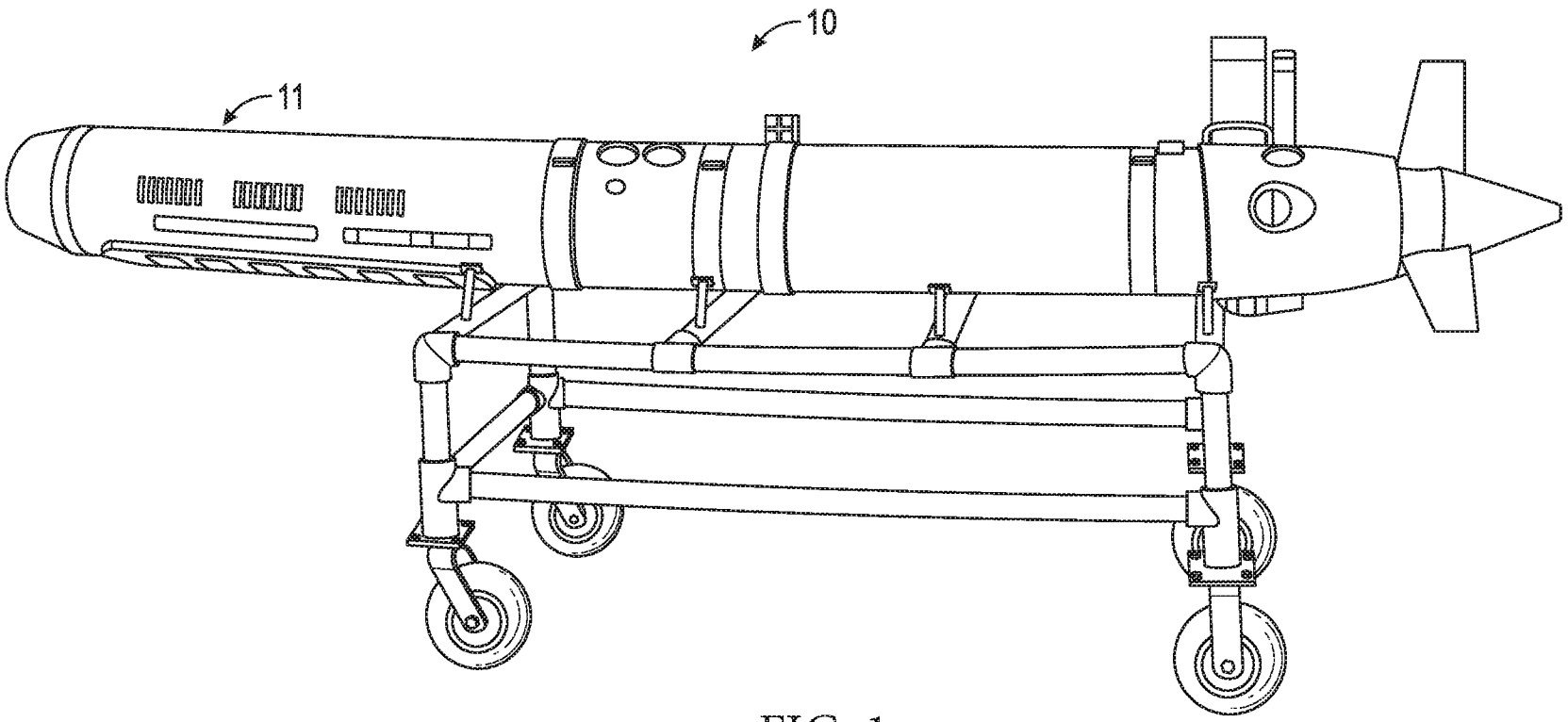
FIG. 1 depicts an image of a vehicle comprising the inventive assembly. The carrier is loaded with deployable payloads in the underside hull of the vehicle, according to one illustrated embodiment.

In one embodiment, the system 11 comprises a separate housing which may be reversibly connected to an object 10 (as shown in FIG. 1). In other embodiments, the system 11 is permanently incorporated into the pressure housing of an object or vehicle 10 (e.g., hull of the vehicle) and the deployment chambers 12 are arranged inside the vehicle's interior. In yet other embodiments, the system 11 is a separate housing that is mounted or attached to an external surface of an object (e.g. a floating buoy platform) by any suitable means known in the art including but not limited to a mount, bracket, strap, or other suitable attachment, most preferably a reversible attachment. Preferably, the system 11 provides for the necessary electrical and vacuum mechanism (e.g. a vacuum source or generator) and connections with each deployment chamber 12 to secure the payload 19 within the system 11 until deployment is desired.

Dry Space.

The deployment chamber's dry space 17, one embodiment being shown in FIGS. 3 and 4A, comprises the necessary components to establish and release the vacuum force in the wet space 18. In one embodiment, the dry space 17 further comprises a vacuum port 13 to connect to the vacuum mechanism 39 and provides the necessary connection to establish a vacuum force capable of securing payload 19 within wet space 18. The dry space further comprises an electrical port 14 adapted to connect and receive at least one of power and data information (e.g. data communication and identity assignment described below) from a power source 41. The dry space 17 further comprises electronics and circuitry 15 and electrical port 14, which enable the control process of establishing the vacuum, removing vacuum and payload deployment, one or more valves 20. The one or more valves may be a slide valve, a spring valve, a piston valve, a Corliss valve, a sleeve valve, a ball valve, or a combination thereof. At least one valve 20 enables fluid influx into the wet space 18, to break the vacuum seal and control the admission of that fluid (that is, start, amount and end) into the wet space 18. Finally, an embodiment of the dry space comprises at least one actuator 16 and actuator switches 21 that enables and drives the deployment process, allowing the admittance of fluid into the wet space and the release of the vacuum seal holding the payload 19. In other embodiments, some components may reside outside the dry space in the system 11 and simply connected to the dry space instead, for example the electronics and circuitry 15 may reside in the system 11.

Wet Space.

The wet space 18 contains at least one payload 19 and is defined by the inner wall 33 of the deployment chamber 12 that is the physical barrier, excluding the external environment (e.g. seawater) from entering dry space 17 or system 10 interior. The dry space 17 engages with the wet space 18 to create a vacuum force, to initiate deployment of the payload 19, and to optionally provide electrical charge to the payload 19. Upon the initiation of deployment, components in the dry space 17 employ the opening of at least one valve 20, allowing fluid to enter into wet space. When fluid enters wet space 18, the vacuum force is dissipated. Vacuum force dissipation can also be referred to as breaking the vacuum seal. Once the vacuum seal is broken, no force holds payload 19 within the wet space 18 and payload 19 is released from the system. During deployment process, the presently void wet space 18 may accept a volume of fluid of a weight, volume, and/or density to compensate for the weight, volume, and/or density of the deployed payload 19.

In the preferred embodiment, the deployment chamber 12 in the system 11 holds the payload 19 by use of a vacuum force with little or no mechanical restraint mechanism (e.g., springs, hinges, fasteners, pins, supports, lids). In an additional embodiment, the deployment chamber 102 holds the payload in the absence of any mechanical restraining mechanism. Similarly, the deployment chamber 12 most often does not require an additional mechanical assist to deploy the payload 19. Previous deployment systems known in the art utilize compressed springs, pistons, or similar means within the chamber to push, project, or otherwise expel the payload from the wet space 18.

Shared Components.

In certain embodiments, the disclosed system comprises a plurality of deployment chambers 12, each requiring a vacuum to create a vacuum force for holding a payload 19. Therefore, each deployment chamber 12 must be configured to connect to a mechanism to create the vacuum force, such as a vacuum pump or the equivalent thereof. In some embodiments, the vacuum force is created within the cavity of the deployment chamber 12 by the vacuum mechanism 39, which comprises a vacuum port 13 adapted to connect with a vacuum mechanism via a vacuum line 22. In one embodiment, the vacuum actuation assembly further comprises a vacuum pump which may be installed on or within the object 10, and the plurality of deployment chambers connect to the same, or a smaller plurality of vacuum sources in object 10. In other embodiments, the vacuum port 13 connects with a vacuum line 22 such as a hollow tube, pipe, or chamber to a point where an external vacuum pump can be connected to draw a vacuum force on the cavity of chamber 12.

In one embodiment, the deployment chambers draw electrical power from a common power source 41. The power source may be in the interconnected object 10, in the system 11, or in some embodiments, integrated within deployment chamber 12, and each deployment chamber comprises its own power source. Typical power sources include batteries, generators (e.g. wave, solar, tidal), and connections to the attached object 10.

In some embodiments, the system 11 further comprises any and all electronics, also referred to as system electronics. Most often, these electronics comprise interconnected controller boards, memory storage and other digital control apparatuses as known in the art. In some embodiments, system electronics are in addition to the deployment chamber electronics and circuitry 15. In other embodiments, the system electronics are the only electronics in the system (i.e. the deployment chambers do not contain electronics or electrical ports).

Vacuum Mechanism

In the preferred embodiment, the system 11 comprises a connection to a vacuum mechanism, also referred to as a vacuum mechanism 39, most preferably located in the attached object 10. The vacuum mechanism 39 is operatively connected the at least one deployment chamber 12. The vacuum mechanism 39 is configured to establish a vacuum in the volume of the wet space not taken up by the payload (i.e. second volume 192). It is to be understood that a vacuum can only be successfully established when the wet space is sealed. The payload 19 of the instant invention provides a sealing zone 35 configured to create a gas- and fluid-tight seal 36 with the inner wall 33 of the deployment chamber 12. The vacuum mechanism enables a vacuum force to be generated and maintained within the wet space 18. In certain embodiments the vacuum mechanism comprises a vacuum pump, or other component capable of creating a vacuum force, as known in the art. In some embodiments the system 11 comprises a vacuum line to the attached object 10, and the object 10 contains the vacuum mechanism. In other embodiments, the vacuum mechanism is an integrated component in the system 11, and is actuated to create a vacuum force in each deployment chamber 12 when a payload 19 is present. In most cases, the payload 19 seals with the deployment chamber 12, specifically at the sealing zone 35, and maintains the vacuum after the vacuum source is no longer active, as commonly known in the art.

The vacuum force and the vacuum seal are created to secure the deployable payload 19 in the wet space 18. In one embodiment, the deployable payload 19 is loaded into the vehicle, and the vacuum mechanism is initially engaged to create the vacuum hold on the payload 19 and is then disengaged once the seal has been achieved between the payload 19 and the chamber 12. In other embodiments, the vacuum mechanism is continually engaged or periodically engaged during the system operation to maintain the vacuum force securing the payload 19 within the deployment chamber 12.

Other components may be installed with or within the system to support the creation and release of the vacuum force including but not limited to the vacuum breaker), 43, valve assemblies, seals, o-rings, valves (e.g., slide valves, vacuum valves, in-line valves, gate valves, water-tight valves, gas-tight valves, ball valves), flanges, bearings, etc. as would be found suitable in the art.

Figure 4B:
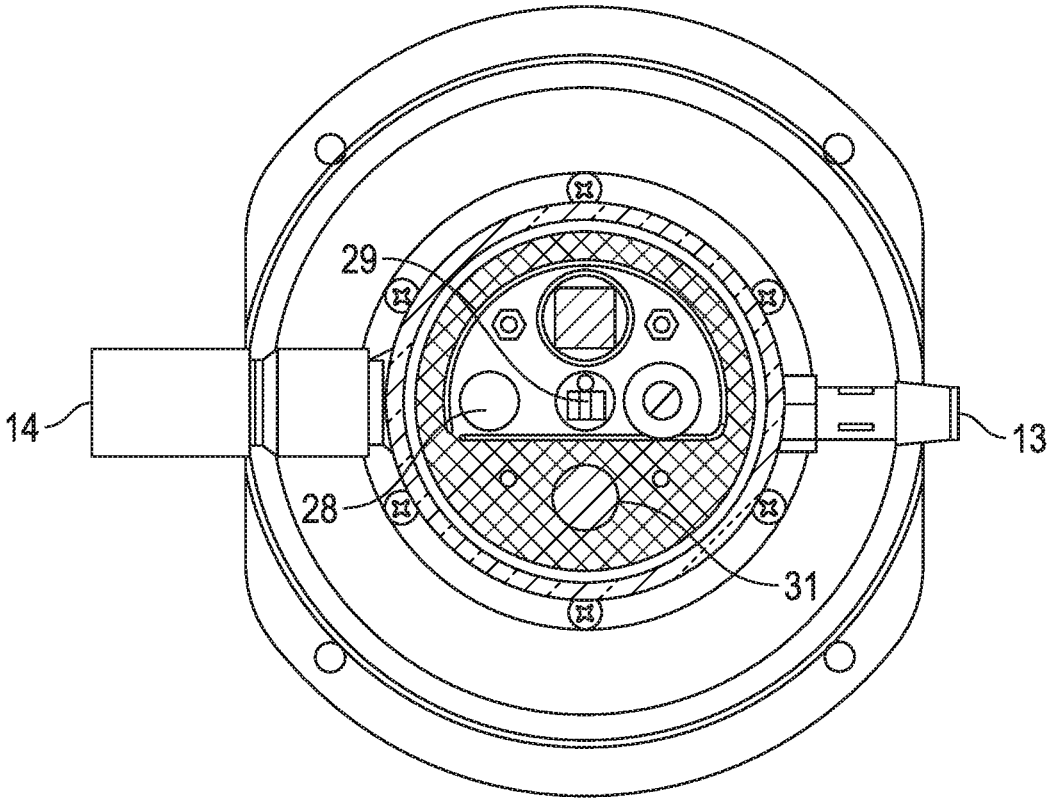
FIG. 4B depicts an alternative view of one embodiment of the internal components of the deployment chamber, which illustrates a portion of the dry space of the deployment chamber including the electrical port and path for electrical connection, components of the vacuum actuation assembly including the vacuum port and the valve, and data communication path.

A plurality of additional sensors 31 may be incorporated into the present system. For example in one embodiment, one additional sensor 31 is a pressure sensor to sense or measure the pressure of the vacuum force within the deployment chamber 12, as illustrated in FIG. 4B.

The deployment chamber 12 is of a suitable volume and size to accommodate the desired deployable payload 19 as shown in FIG. 4A. In general, any size, shape, or fitting may be suitable as long as the payload 19 may be maintained within the chamber 12 by vacuum force. Additionally, the shape and fit of the chamber 12 must be designed so that the vehicle maintains the desired degree of vehicle buoyancy (e.g., no buoyancy change, partial buoyancy change) after deployment of the payload 19. A snug fit is most often preferred, wherein the inner contours of the chamber 12 to some extent match the outer contours of the payload 19. The base of the payload's body housing 23 fits substantially nested against the inner wall of the deployment chamber 12 to allow a vacuum seal to be maintained even while submerged. In many embodiments, when the payload 19 is present within the chamber 12, additional free space will be less than 10% of the total portal volume. Such designs and other designs to minimize or maximize the additional free space are known in the art.

The deployment chamber 12 is fabricated to provide and hold a vacuum-tight seal at least in wet space 18 and generally a water-tight seal in the dry space 17 to avoid fluid leakage into any other undesirable section of the system 11. The deployment chamber 12, specifically the deployment portal 30, must be capable of sealing with a vacuum-tight seal and maintaining said seal until deployment of the payload 19 is desired. In most instances, the deployment portal seal will be present as part of the payload 19, although when necessary, other simple flaps, lids, or covers may be used to provide or assist the vacuum seal. In such alternative cases, the seals may be free standing or have some flexible attachment to the object (e.g., a tape, strap, or breakable hinge). A seal such as an o-ring may line the inner circumference of the deployment chamber 12 or the outer circumference of the payload 19 to further assist in maintaining the vacuum seal. Such a seal on the payload, preferably is at the sealing zone, and contributes to the seal created at the sealing zone. In all cases, consideration must be made regarding the intended depth of use of the invention, and the deployment portal's vacuum seal and its components must be able to resist not only the applied vacuum but also the externally generated pressure at the depth of use.

The system and deployment chamber can be constructed from a variety of materials. In one embodiment, the system 11 and/or the deployment chamber 12 are comprised of metal such as steel, stainless steel, aluminum, cast iron, titanium, metal alloys, or other suitable material of a solidity appropriate for stresses of aquatic environments including moisture, pressure, and salt. In an additional embodiment, at least one of the system 11 and deployment chamber 12 are fabricated from carbon fiber, carbon fiber composite, carbon fiber-reinforced polymer, or similar material. Thermoplastics or mechanical grade plastics could also be utilized. In an additional embodiment, the system 11 is composed of aluminum to reduce overall weight of the vehicle. In a further embodiment, the system 11 is constituted from steel or steel alloy for overall strength. In a further embodiment, the system 11 is comprised of corrosion-resistant materials to prevent deterioration due to wet and/or salty conditions. Protective coatings and/or laminations may be appropriate to further protect the fluid-exposed portions of the system 11 such as zinc coating, chrome plating, paint, epoxies, etc. Galvanization processes may be applied to the components of the system 11 to prevent deterioration. It should be understood that the following materials are intended to serve as examples of the different materials that can be used for the system and that nothing in this application should be interpreted to restrict the invention's construction to the above listed materials.

There is no restriction on the system's integration to an object or vehicle, regardless of whether the system 11 is a stand-alone segment meant to attach to a vehicle or other object or connect with a segment of a vehicle or object. In one embodiment, the system is integrated into the underside of the platform or hull of a vehicle in a downward facing orientation. In another, the system is integrated into a side or multiple sides of the hull. In a further embodiment, the system is located in the posterior or the anterior region of the hull.

Deployment Chamber Vacuum Levels

The payloads in the instant invention are retained by drawing and maintaining a vacuum within the deployment chambers. In one embodiment, the payloads are held solely by the vacuum source. Therefore, unintentional break of vacuum force and release of a payload is undesirable. Unintentional payload release may occur from extreme temperature or external force acting on the system, knocking a payload out of the deployment chamber. The instant invention provides a system and method to maintain payloads in different temperature and external force environments.

The effects of temperature on the system can be calculated as described for one embodiment. Air is assumed to behave as an ideal gas (PV=nRT) with no expected phase change. Deployment chamber volume is constant ($p \propto T$) and can be consistently evacuated to a vacuum of 200 millibar (mbar) when payloads are loaded therein. The minimal payload loading temperature is 30° F. and the maximum temperature during system operation is 140'F. The effect of temperature on the vacuum in the deployment chamber can be described the below equation, where p1 and T1 are starting pressure (lower pressure equals more vacuum) and temperature and p2 and T2 are ending pressure and temperature.

$$\frac{p_1}{T_1} - \frac{p_2}{T_2} \rightarrow P_2 = p_1 \frac{T_2}{T_1}$$

Figure 8:
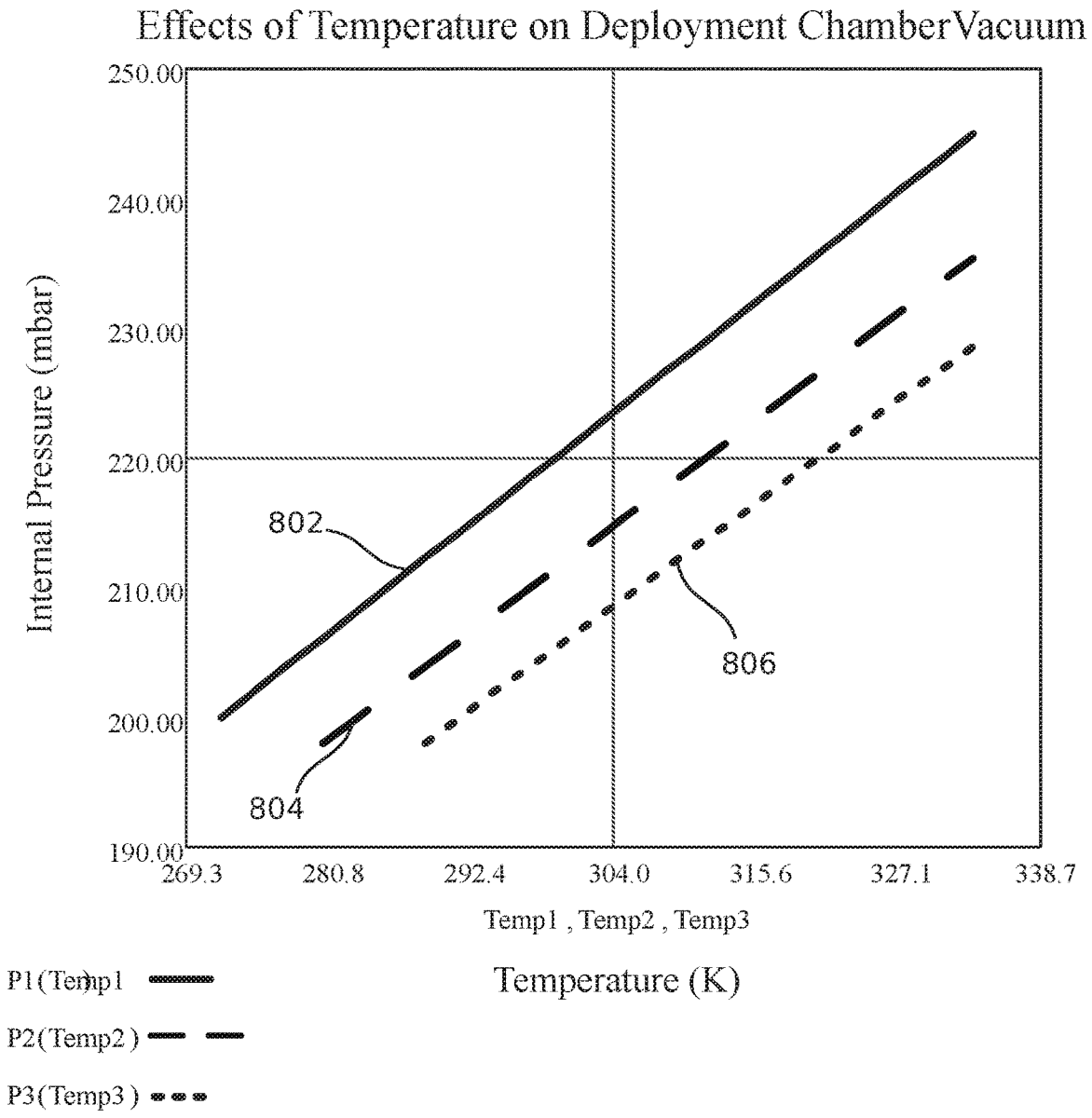
FIG. 8 shows the effect of temperature on the vacuum established in a deployment chamber of one embodiment.
Figure 9A:
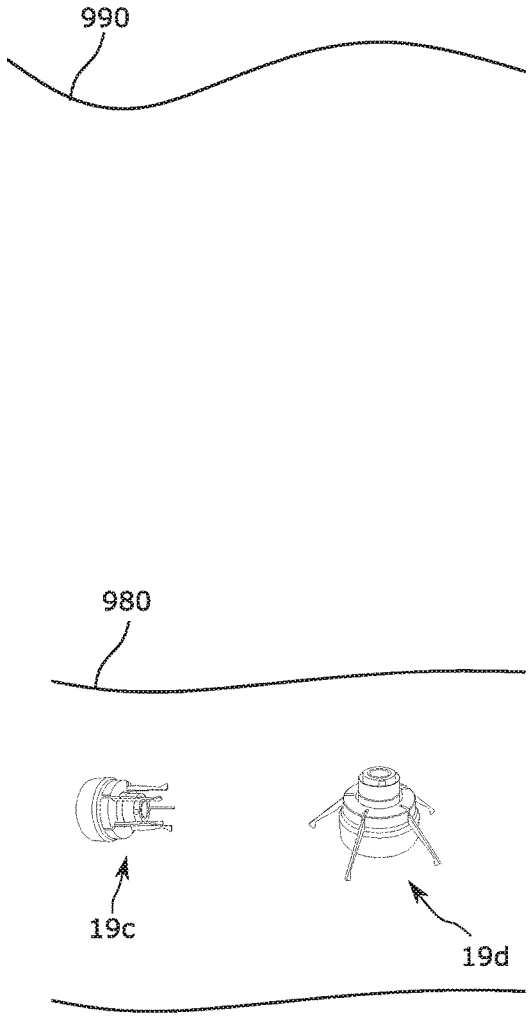
FIG. 9A illustrates one embodiment of the present invention depicting a payload having been dropped to the fluid-body floor in an optimal position and self-reoriented into an optimal, upright position.
Figure 9B:
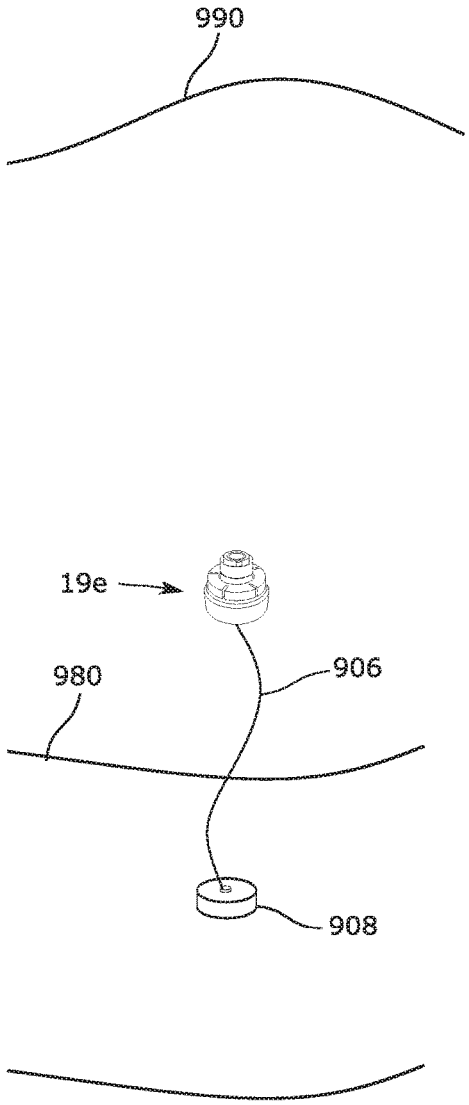
FIG. 9B illustrates an embodiment of a payload hovering in the fluid environment while tethered to the fluid-body floor.
Figure 9D:
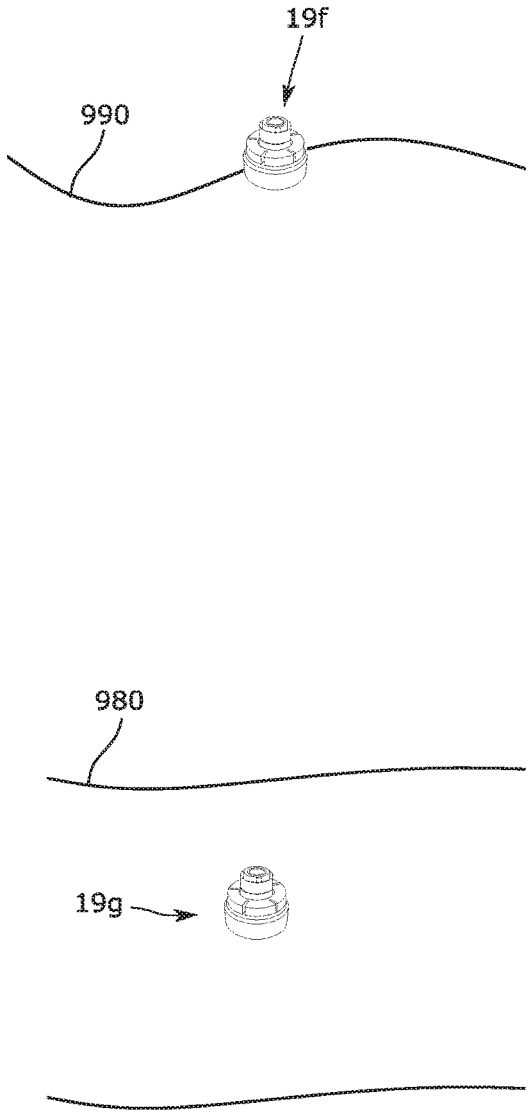
FIG. 9D illustrates another embodiment of a deployed payload floating in the fluid environment at a neutral buoyancy.
Figure 9C:
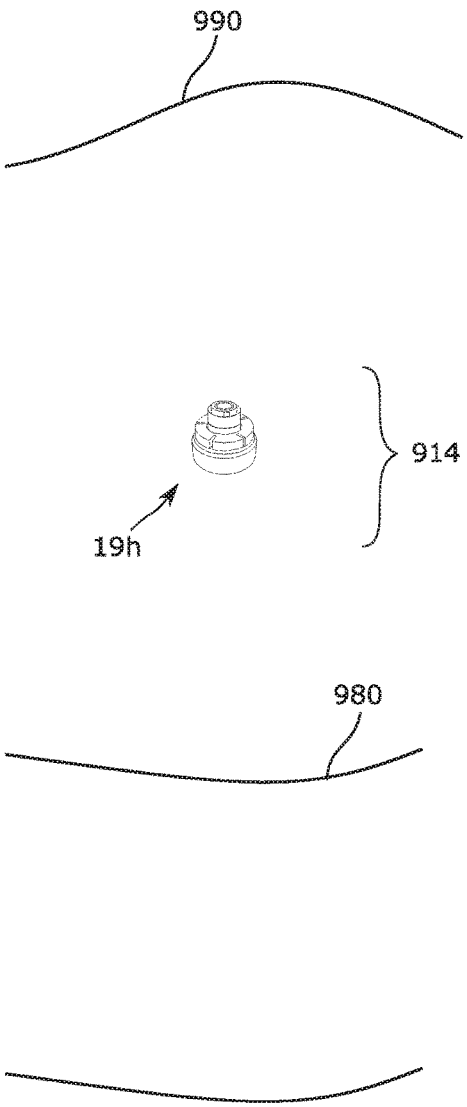
FIG. 9C illustrates an embodiment of two deployed payloads, one payload having a positive buoyancy and the other a negative buoyancy; the positively buoyant payload floating to the fluid-body surface and the negatively buoyant payload sinking to the fluid-body floor.

The results of a test of the disclosed method are shown in FIG. 8. Three initial temperatures were tested (Temp1, line 802 at 30° F., Temp2, line 804 at 45° F. and Temp3, line 806 at 60° F.) with initial pressure of 200 mbar, and demonstrate that as operation temperature increases, internal pressure remains acceptable, with less than 50 mbar increase of the internal pressure in a loaded deployment chamber.

External forces (shock loading) experienced during system operation can be substantial. Payloads must not be released during transit to or from area of operation, for example. The force required to extract a payload of the instant invention may be obtained by external sensors mounted onto the system, or a similar vehicle. In one embodiment, a payload in a typical system embodiment, under a 250 mbar vacuum, is capable of holding 128 pounds of payload, before the vacuum force is overcome. The following example exemplifies the force equation for the force required to overcome a vacuum pressure. It is understood that the various parts of the system are adaptable to hold a wide variety of payload types.

The method and formulas to calculate payload holding force due to a vacuum will now be described and a specific example given. The payload properties important to the calculations are sealing diameter, payload weight, and deployment chamber vacuum. The G-forces required to overcome the vacuum force are calculated by first calculating the area subject to vacuum, see Eq. 1. Which in turn is used to calculate the differential pressure across the payload (Eq. 2), and that is used to calculate the holding force (Eq. 3). Finally, the G-forces are calculated in Eq. 4.

$$\text{Area} = \pi\left(\frac{SealingDiam}{2}\right)^2 \quad \text{Eq. 1}$$

$$\Delta\text{pressure} = P_{out} - P_{vacuum} \quad \text{Eq. 2}$$

$$\text{Holding} = \text{Area} \times \Delta\text{pressure} \quad \text{Eq. 3}$$

$$Gs = \frac{\text{Holding} - \text{Payload weight}}{\frac{\text{Payload weight}}{1G}} \quad \text{Eq. 4}$$

In an example of a payload and deployment chamber, the sealing diameter is 3.85 in, the payload weight is 2.25 lbs and vacuum is 0.25 bar, which leads to an area subject to vacuum of 11.64 inches squared, a differential pressure of 11.07 psi (assuming 1 atm of the outside pressure), a holding force of 128.87 lbf. Finally, the G-force of this one example is 56.28 G. For comparison, a fighter pilot will typically experience up to 6 Gs.

Deployable Payloads.

In the preferred embodiment, at least one deployable payload 19 is loaded and stowed into the deployment chamber 12. Depending on the operator's application, the system can make use of as many payloads as needed, as long as the plurality of payloads are capable of forming a fluid-tight seal 36 with the deployment chamber. Each payload 19 and associated chamber 12 are designed to allow the payload 19 to be securely loaded into the internal cavity (e.g., wet space 18) and to be held by a vacuum force. In some embodiments, the deployable payload 19 is loaded in an orientation such that the base (e.g. a first surface) 34 of the payload is flush with the object's outer hull, as illustrated in FIG. 2. Payloads 19 further comprise a surface area or sealing zone 35 that is in contact with the system, most often the deployment chamber that creates the seal enabling the vacuum force to retain the payload 19. Sealing zone may be directly proximate to the base 34 (e.g. payload is flush or recessed with object's hull), or removed from it (e.g. payload extends outward from object's hull).

The payload 19 may be any suitable unit desired to be deployed submerged capable of withstanding fluid immersion, and that is capable of fitting into and forming a seal with a corresponding deployment chamber. Furthermore, the payload 19 may be any suitable unit that is capable of being held by a deployment chamber 12 by a vacuum source within that deployment chamber. Preferably, the payload 19 is held solely by a vacuum force, generated by the vacuum source. In other embodiments, the payload is held both by a vacuum force and by a mechanical restraint. The payload 19 is referred to as held sustainably by vacuum force when the force required to hold the payload in the deployment chamber is derived at least 75% from a vacuum force.

The payload 19 may be a marker, a beacon, a navigation device, an expendable buoy, a sonar calibrating device (such as described in U.S. patent application Ser. No. 14/844,038), or other suitable location-reporting device. In other embodiments, the deployable payload 19 is a sensor or array of sensors (e.g., conductivity, temperature, moisture, motion, seismic, light, pressure, acoustic, gaseous composition), a transmitter, a munition (e.g., a mine), robot, optical device (e.g., a spectrometer, an interferometer, a photometer), an acoustic communication or signaling device (e.g., pinger, modem), an optical communication or signaling device (such as a communication unit such as found in U.S. Pat. No. 7,953,326), a hydrophone, an actuator, a light, a strobe, a camera, a sampler, any suitable type of a transducer, a transponder, a transceiver, any combination thereof, or any other suitable device as known in the art.

In one embodiment, illustrated in FIGS. 4A, 4B, 5A, and 5B the deployable payload 19 comprises a main water-tight (e.g., gas-tight, sealed) body housing 23 with an internal space for the payload electronics 32, a power source 41, a self-orienting means 24, and a leg release mechanism. In general, the body housing 23 is a suitable compartment which even upon light to moderate impact (and in some cases heavy impact), the body housing 23 prevents the entry of fluid as well as environmental contaminants (e.g., salt, biofouling) into the internal space.

In one embodiment, the power source may comprise one or more batteries, including but not limited to alkaline, nickel cadmium, nickel metal hydride, lead acid, lithium, or lithium polymer. In one embodiment, the vehicle may perform battery diagnostics and acquire and/or relay information of the status of battery charge or battery life of each payload 19 to a designated location such as a vessel, a buoy, a float, a land facility, or other site.

The deployable payload 19 may be of a low relief (i.e., low vertical profile) and compact form. Low relief is defined as the ratio of height to width. Low relief payloads are 5:1, 2.5:1, 1:1, and 0.5:1 ratios of height to width. A compact design allows the inventive system to load multiple payloads 19 within a compact space such as the narrow hull of an AUV. Furthermore, a low relief payload is able to sit on the fluid bottom floor with minimalized disturbance from the motion, drift, or current of the fluid. In some applications, the deployable payload 19 is made of a low relief to reduce the overall profile with respect to active sonar in covert operations.

In one embodiment illustrated in FIGS. 9A-9D, the deployable payload 19*c* is released from the system 11 into the fluid environment and descends to the bottom of the fluid environment's floor 980 (e.g. the seafloor); in another embodiment, the deployable payload 19*e* is released and remains hovering (e.g., floating) over the fluid bottom floor 980 tethered to a weight 908 (e.g., anchor) by a line or tether 906. In other words, an anchored payload 19*e*, is positively buoyant, but remains hovering by aid of the weight 908. In the embodiment that includes a tethered payload 19*e*, the payload is suspended from the bottom of the fluid body at a distance found suitable by the operator. In the preferred embodiment, the deployable payload 19 may also be fabricated to meet the criteria for a particular depth of fluid. In further embodiments, the payload is deployed as two payloads, a first payload 19*f* being positively buoyant, and a second payload 19*g* being negatively buoyant. Payload 19*f* floats towards the surface 990, or to a depth of neutral buoyancy (i.e. a depth payload 19*f* is ballasted to be neutrally buoyant in a given fluid depth). While payload 19*g* sinks to the fluid floor 980. In other embodiments the second payload 19*h* is configured to sink to a second depth of neutral buoyancy 914. Unlike tethered payload 19*e*, a neutrally buoyant payload 19*h* (e.g. a drifting payload) will remain in the fluid environment at a depth. Buoyancy at a given depth is determined by pressure, salinity and temperature. Together, payloads 19*f* and 19*g* or 19*h* enable the vehicle to maintain the net buoyant force before and after deployment. In still further embodiments, the payload is reversibly deployed from the system, and is configured to return to the deployment chamber. Such payloads utilize known homing and positioning systems, preferably in communication with the object 10 to which the system 11 is attached. Typically, the payload will further comprise a releasable weight, enabling it to buoyantly rise into the deployment chamber after release of the weight. In other cases, the payload comprises a propulsion system, enabling it to move into a deployment chamber.

Each deployable payload 19 may be designated a specific identifier (e.g., number, code, physical marking), recorded in the payload electronics 32, to distinguish one payload 19 from others deployed in the area. In some embodiments, each payload 19 is identical in appearance and interchangeable with other payloads 19 and with other deployment chambers 12 in the system 11. The deployable payload 19 may contain data information or location-determining devices, acoustic or optical communication components, and identity assignment via infrared data association (IrDA) links to allow communication with the vehicle or other remote location. A specific identity may be assigned to each individual payload 19 by the vehicle via the vehicle's electronics or via a remote signal provided by operator. This may be accomplished through the data communication path 29 which provides a water-tight connection between at least the payload 19 in the wet space 18 and the dry space 17 and the attached object 10 (FIG. 4B). In certain embodiments, the payload 19 is capable of acoustic communications.

In some embodiments, the deployment chamber 12 comprises more than one payloads 19 which release together when deployment in initiated by the operator. In such instances, each payload 19 may be identical in function (i.e., comprise the same communication components, sensors, signaling devices, etc.) or each may serve a unique function such as one payload for location-reporting and another payload for sensing surrounding parameters.

Self-Orienting Means.

In the preferred embodiment, the system will further comprise self-orienting means to allow the payload to correct its orientation. Positioning and orientation are important factors in accomplishing effective submerged operation of deployable payloads 19 on the fluid bottom floor. Orientation is particularly important in cases when the payload 19 is a communication node with directional signaling communication. Each deployed payload 19 generally falls away from the vehicle above the targeted position which can range from being deployed a couple of inches from the fluid bottom floor up to several hundred feet above the bottom, and in some instances several thousand feet above the bottom. Therefore, the payload 19 is likely to be disoriented upon contact with the bottom and often needs to be realigned to an upright operational position.

The deployable payload 19 comprises a self-orienting means 24 which allows the payload 19 to correct its orientation without external assistance. The self-orienting means 24 is characterized by a set of stabilizing leg supports comprising one or more stabilizing legs, referred to as the leg assembly 25, attached to the body of the deployable payload 19 as a means properly orient or level the deployed payload 19 in a functional position on the underlying surface (e.g., seafloor). In preferred embodiments, illustrated in FIG. 9, the self-orientating means orients the payload 19*c* from a non-upright position to an upright position 19*d*. Most often orientation occurs on the fluid bottom floor. Such self-orientation may be critical for directional communications or minimalized shuffling around the fluid bottom floor when in operation. Upon release to a desired location, the payload 19 may land on its side or other unsuitable position. Therefore, the leg assembly 25 is employed to extend the leg supports out and away from the body of the payload 19 to correct and stabilize the orientation. Such an assembly 25 may also dig into the bottom floor to prevent unintended movement caused by the natural motions of the fluid.

Figure 5A:
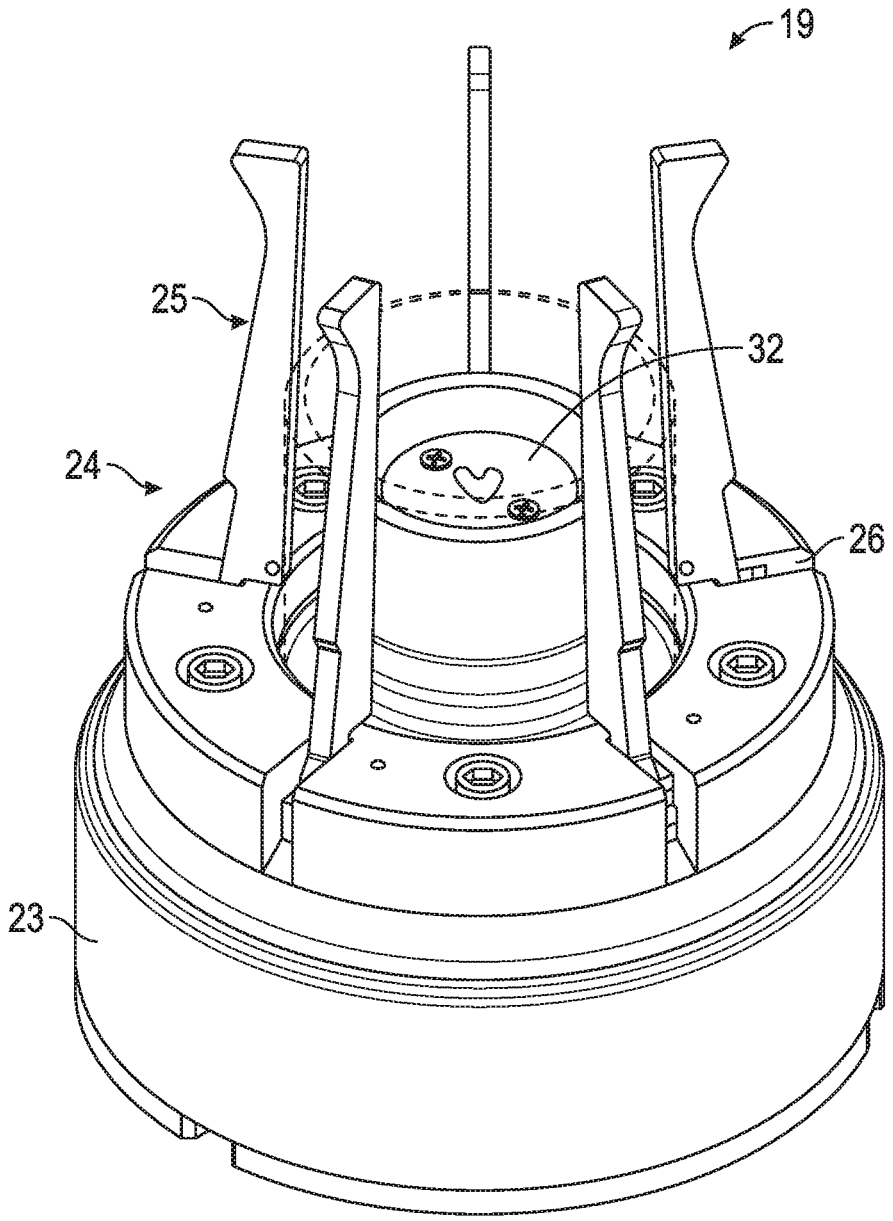
FIG. 5A depicts one embodiment of the deployable payload.
Figure 5B:
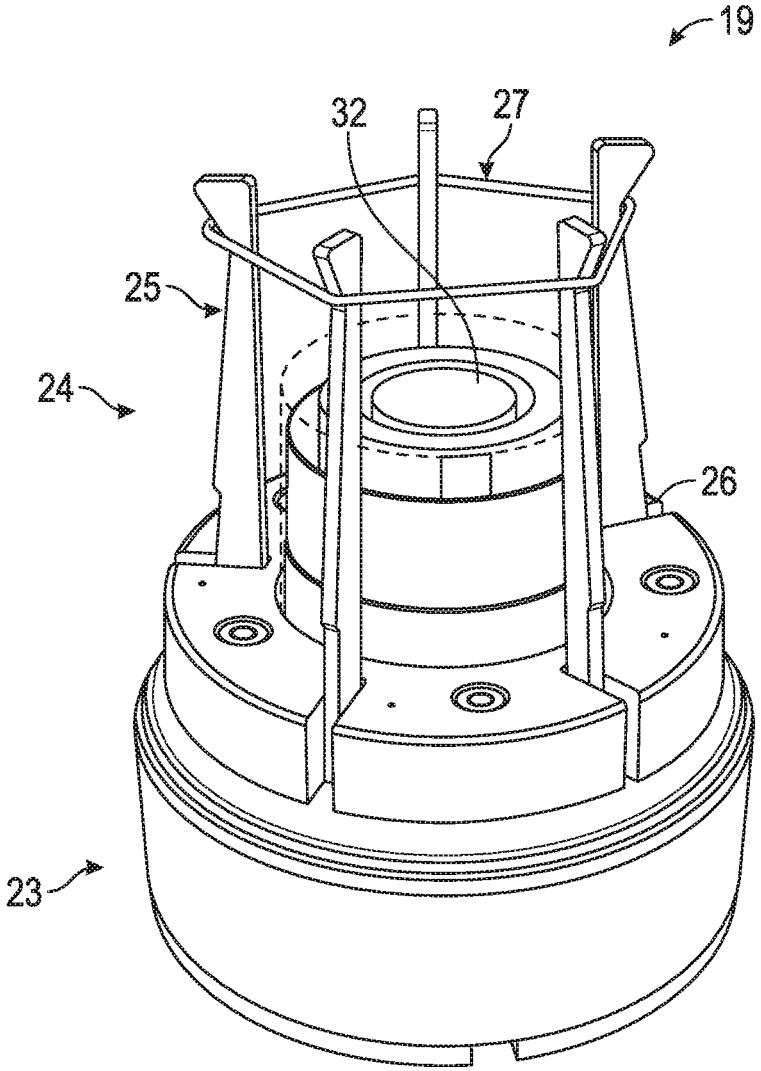
FIG. 5B depicts the deployable payload in the stowed position wherein the leg assembly is secured by the engaged leg release mechanism.
Figure 5C:
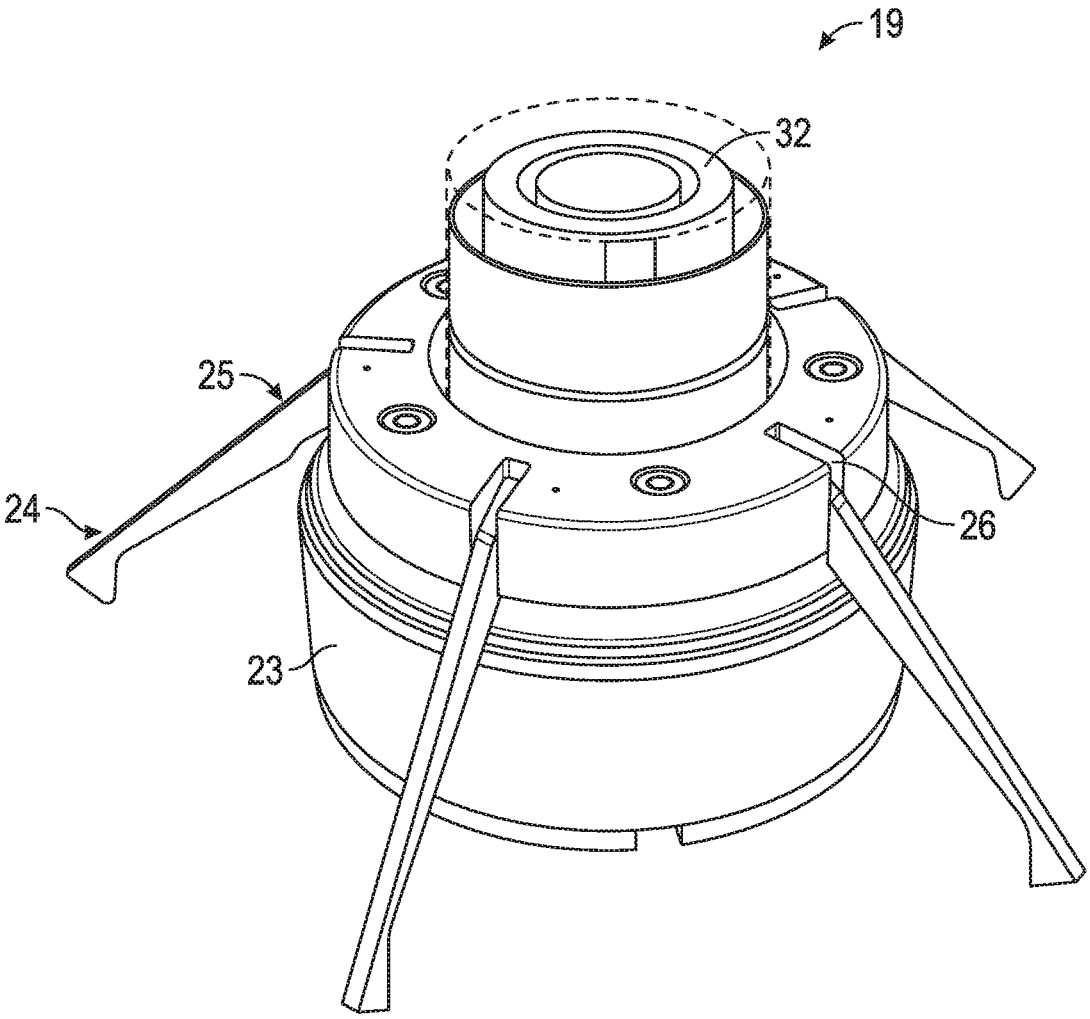
FIG. 5C depicts one embodiment of the deployable payload wherein the leg release mechanism is disengaged and the leg assembly is allowed to extend and stabilize the payload.

As shown in FIG. 5A, the self-orienting means 24 is comprised of the leg assembly 25, leg attachment points 26, and a leg release mechanism 27. The legs are attached to the main body housing 23 of the payload 19 at the leg attachment points 26 wherein this attachment point 26 is the point of leg rotation. In some embodiments, the legs are attached to the main body 23 by springs. In other embodiments, the stabilizing legs are attached to the main body by hinges, pins, or similar means. In the preferred embodiment, the legs are substantially equally spaced and secured to the body housing 23 of the payload 19. In an additional embodiment, particularly when internal components in the payload 19 are not equally distributed in weight resulting in one side of the payload 19 to be heavier than the other, the legs are secured to the payload 19 at positions to counter a difference in weight contribution and stabilize the payload 19 on the underlying floor.

Prior to deployment, the leg assembly 25 remains secured in a stowed position by the leg release mechanism 27 (i.e., the first position or stowed position). In some embodiments, the leg assembly 25 is secured in an upright position with the legs angled toward the center of the main body housing 23 of the deployable payload 19 (FIG. 5A). However, the leg assembly may be stowed in any suitable position to prevent the legs from prematurely engaging with a surrounding surface. Once the deployable payload 19 has been released from the vehicle, the payload 19 falls to the fluid bottom floor, and the leg assembly 25, secured in the upright position, is released, allowing the stabilizing legs to pivot and extend downward (FIG. 5B) (i.e., the second position or extended position). The legs then pivot at their point to rotation (i.e., attachment point 26 to the main body 23) and contact the underlying fluid bottom floor. While the current embodiments disclose two positions (first and second positions) for the legs, a person skilled in the art will recognize that there are countless positions that the legs could be positioned in after the release of the leg release mechanism. Nothing in this disclosure shall be interpreted to limit the disclosures as to the positions of the payload legs.

There are multiple methods by which the leg release mechanism can be engaged. In one embodiment, the leg release mechanism 27 is time-delayed slightly after deployment to allow the payload 19 to first make contact with the fluid bottom floor prior to releasing the stabilizing legs from their initial stowed position. In other embodiments, the leg release mechanism 27 is delayed only until the payload 19 has exited the deployment chamber 12, allowing the legs to be extended prior to contact with the ground. In still other embodiments, the leg release mechanism 27 is delayed until a signal is provided to the payload 19 to release the leg assembly 25. In some applications, the leg release mechanism 27 is controlled by a dissolvable substance (e.g., dissolvable band, dissolvable holder, water-soluble ring), which upon contact with fluid dissolves, releases the leg assembly 25, and allows the legs to pivot and extend from the body 23 of the payload 19 for orientation. In other embodiments, the leg release mechanism 27 is disengaged by a timed-release device, which after a specific amount of time after deployment allows the legs to extend and orient the payload 19. In some embodiments, the leg release mechanism 27 is part of the system 11 and leg release occurs substantially upon deployment.

Lea Release Mechanism.

The sequence of the leg release process involves the platform or vehicle first determining the desired location and/or time to release the deployable payload 19. The vehicle may remain in motion, in buoyant suspension, or may rest at the bottom of the water body until signaled to initiate deployment of the payloads 19. Upon initiation of deployment, the actuation assembly internal to the system 11 is opened to an inflow of fluid (e.g., fluid, water, seawater, fresh water) which disengages the vacuum seal holding the deployable payload 19 in place and allows the payload 19 to fall away or be released from the platform.

Simultaneously, as the deployable payload 19 is falling away from the vehicle, the now void wet space 18 of the deployment chamber 12 becomes available to completely or at least partially fill with fluid, immediately compensating the weight of the deployed payload 19. This process may then be independently repeated with more or all of the remaining deployable payloads 19 still stowed aboard the vehicle. In some embodiments, only one or a portion of the available deployable payloads 19 is deployed from the vehicle. In most cases, no additional changes are required by the operator of the vehicle to compensate for the changes in weight (i.e., ballast).

Payload Uses.

The payloads 19 provided for by the instant invention may be used for any purpose as known in the art. The invention described herein is especially suited for marine (e.g. oceangoing) uses, including oceanographic research, defense and military operations, natural resource exploration and extraction and search, rescue and recovery. Payloads may be configured to perform these duties. In particular, payloads designed to mark mines, detect electromagnetic signals (e.g. acoustic pings from recovery boxes), emit electromagnetic signals, store or hold an object until needed (e.g. an aquatic mine or a stored weapon), measure a parameter of the fluid environment (e.g. a conductivity, temperature and pressure probe) or facilitate communications (receive, relay or transmit), and guide individuals (e.g. divers) or other underwater vehicles (e.g. a series of guiding, smart breadcrumbs), are all possible uses for payloads of the instant invention.

The manner in which each payload interacts with the fluid environment is also configurable. Payloads may be negatively buoyant, and designed to sink to the floor of the fluid environment (e.g. the seafloor). Some payloads may simply come to rest as is on the fluid environment floor, others are provided leg assemblies which in turn deploy after payload deployment from the deployment chamber, as described above. In other cases, they may be designed to be neutrally buoyant at a specific depth, and will float in the fluid environment column at that depth. In still further cases, payloads may be configured to be positively buoyant and float to the fluid body surface upon deployment. These payloads may be used for relay communications, marking points of interest and the like. Payloads may further comprise buoyancy mechanisms, for example compressed air and bladder system, or actively pumped ballast tanks. For positively buoyant payloads, the payload may comprise a group of payloads, all deployed at the same time to offset vehicle buoyancy changes. A group of payloads may be deployed from one or more deployment chambers. Furthermore, multiple payloads may be directly attached to one another, deployed from a deployment chamber, and separate after deployment while in the fluid environment. In this way, these grouped payloads may have different buoyancies. Payloads may further attach to objects in the fluid environment, including other payloads. Attachment modalities are known in the art, including magnetic attachment, attachment by suction, physical penetration (e.g. a harpoon). Two payload examples are given below.

Buoyancy Compensation.

A fundamental challenge in the design and utilization of a system for deploying submerged objects is the need to counteract the effects of weight (and density) changes of the system and the attached object, particularly a vehicle, as the payloads are deployed. It is optimal during submerged operation to minimize the range of buoyancy changes and ensure that the vehicle maintains and adequately controls depth adjustment in the fluid. As weights (i.e., payloads) are removed from the vehicle, buoyancy increases, potentially offsetting the expected trajectory of the vehicle if not properly compensated. Measuring buoyancy changes while submerged and underway is very difficult, therefore the instant invention provides a practical and ideally automatic mechanism to adjust for weight changes as payloads are deployed. Additionally, it may be advantageous for certain operations to provide a system which deploys payloads and compensates for their weight in a quiet manner without excess mechanical noise and substantial amounts of air bubbles.

These changes in buoyancy may be minimized by a fluid-based buoyancy compensation method, referred to herein as the offset mechanism wherein the weight lost by the deployment of the payload is offset or compensated by a weight of fluid (e.g., water, seawater, fresh water). In one embodiment, the offset mechanism 45 comprises the volume and density of the payload 19, and the density and volume of the system 11. An object's buoyancy (i.e. buoyant force) depends on its volume and density and its force of gravity. Therefore, the offset mechanism 45 ensures that the density and volume of the invention (system 11 and attached object 10) is the same before and after payload 19 deployment. A payload can be expressed as having a volume V and a mass m. And for the buoyancy of the invention to remain substantially unchanged during deployment, the buoyancy of the vehicle 10 without payloads 19 must be at least close to the combined buoyant force of vehicle and payloads.

The buoyant force before (i.e., the first buoyant force) and after payload deployment (i.e., the second buoyant force) is shown in Equation 5. The left side of Eq. 5 contains the buoyancy force of the combined vehicle or system and payload, while the right side of Eq. 5 contains the buoyant force of the vehicle or system alone. The degree to which the two sides are allowed to diverge, depends on the embodiment and the mission.

$$((V_{vehicle}+V_{payload})\times D_{fluid}\times g)-((m_{vehicle}+m_{payload})\times G) \cong (V_{vehicle}\times D_{fluid}\times g)-(m_{vehicle}\times G) \quad \text{Eq. 8}$$

Figure 7A:
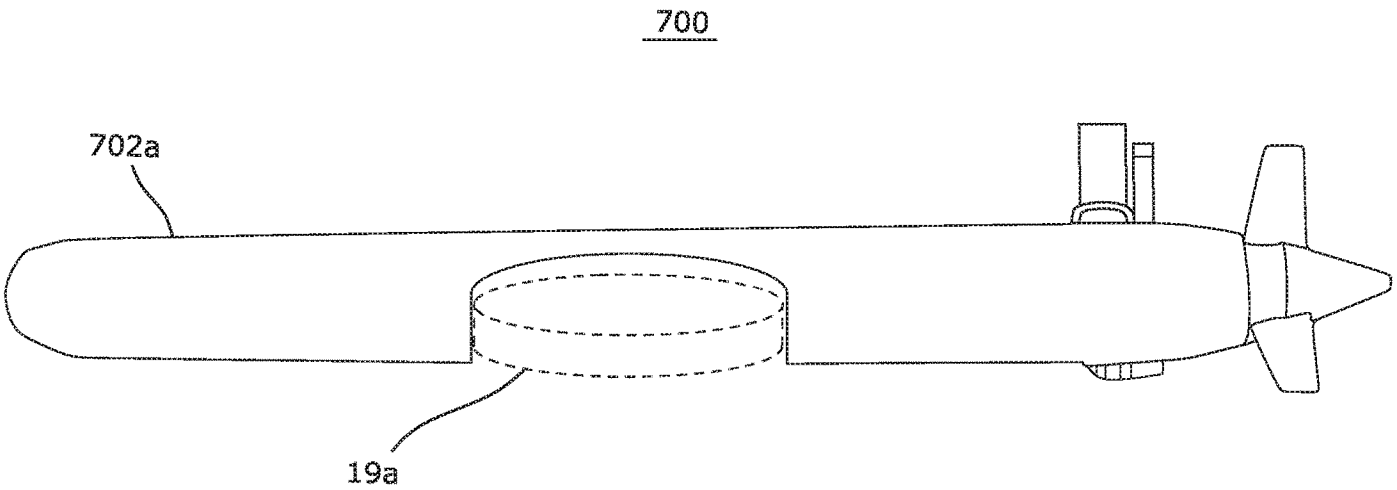
FIG. 7A depicts one embodiment comprising a buoyancy offset mechanism of the present invention, wherein the payload has not yet been released.
Figure 7B:
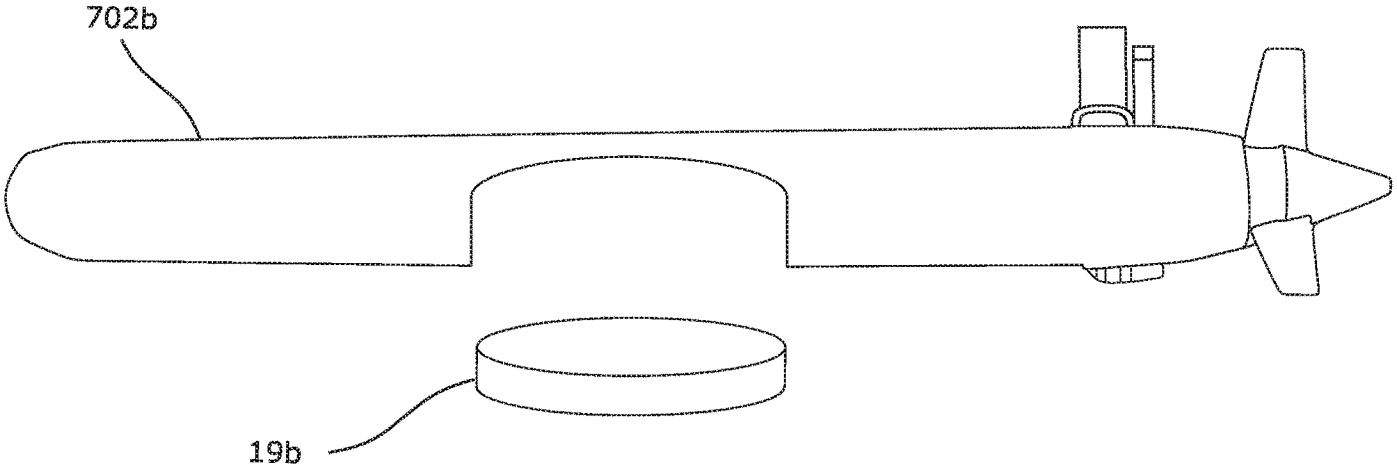
FIG. 7B depicts one embodiment comprising a buoyancy offset mechanism of the present invention, wherein the payload has been released.

Equation 5 is illustrated in FIGS. 7A and 7B in simplified terms for a hypothetical vehicle 702 (comprising system 11 and object 10) with a volume of 0.99 meters cubed and a weight of 1,010 kilograms. In this example, the offset mechanism provides the above vehicle and a payload 19 with a volume of 0.009 meters cubed and a weight of 10 kg (stowed payload 19*a* shown in dashed lines, FIG. 7A, and released payload 19*b* shown in solid lines, FIG. 7B). The vehicle 702*a* and stowed payload 19*a* has an Fb of 10,104 Newtons and an Fg of 9,908 N, giving it a positive buoyancy of 196 N. After payload deployment, the vehicle 702*b* has an Fb of 10,013 N and an Fg of 9,810 N, giving it a positive buoyancy of 203 N, representing only a 3.5% change in vehicle buoyancy before and after payload deployment. Buoyancy offset may further comprise the release of multiple payloads, from one or more deployment chambers. For example, a desired payload that negatively impact vehicle buoyancy may be released with an at least one payload that offsets the desired payload's buoyancy impact (i.e. a dummy, drop weight payload).

Depending on the embodiment and the mission, the present invention tolerates a range of buoyancy changes. In the preferred embodiment, the offset mechanism corrects for all but 1% overall vehicle buoyancy change. In other words, the buoyancy mechanism results in a 1% buoyancy change after at least one payload deployment. In other embodiments, the offset mechanism results in a buoyancy change between preferably 2-10% buoyancy changes, less preferably 10-20% buoyancy changes, after payload deployment. Substantially no buoyancy change is defined as less than 1% buoyancy change of the overall vehicle (system 11 and attached object 10 together). In one embodiment, the first buoyant force is not more than 20 percent different than the second buoyant force. In an additional embodiment, the measure of the first buoyant force does not exceed the measure of the second buoyant force by more than 20 percent. In a further embodiment, the first buoyant force is not greater than 20 percent greater than the second buoyant force or not 20 percent less than the second buoyant force. In a further embodiment, the first buoyant force is substantially equal to the second buoyant force. In an additional embodiment, a third buoyant force comprises the buoyant force of the offset mechanism, at least one payload, and the system, and the third buoyant force does not differ more than 20 percent from the second buoyant force. In a further embodiment, the measure of the third buoyant force does not exceed the measure of the second buoyant force by more than 20 percent. In a further embodiment, the second and third buoyant forces are substantially equal.

It is important to note that the volume inside the wet space 18 when no payload is present is contiguous with the fluid environment, and the density of fluid the fills that wet space does not contribute to buoyancy of the vehicle, because the vehicle does not displace it. Therefore, to properly correct for buoyancy, the offset mechanism demands that volume and density of the payload must adhere to Equation 4 above. It is to be understood that the invention will displace less fluid after deployment, therefore the offset mechanism Buoyancy offset is done accomplished by a passive means in which the wet space 18 of the deployment chamber 12 holding the deployable payload 19 provides the space accepting fluid to enter the system and compensate for the missing payload's weight. After deployment, this space is no longer part of the vehicle's displaced volume. In other embodiments, initiation of deployment actuates the opening of valves and/or associated components, specifically the actuation assembly, such that the vacuum force holding the payload 19 is disengaged, the payload 19 is deployed, and the wet space 18 fills with a compensating weight of fluid.

In some applications, no additional mechanical devices are necessary such as pumps, motors, or other means to bring fluid into the vehicle. In others, fluid is pumped into the cavity of the deployment chamber 12 by the vacuum breaker 43, comprising a suitable pump to break the vacuum seal holding the payload 19 and causing the payload 19 to be released from the vehicle.

In some cases, offset mechanism 45 further comprises additional weight-assistance items, located in the wet space 18, such as weights, flotation devices (e.g., buoys, inflatables, foam, buoyant objects), or other suitable means to compensate for buoyancy changes upon the deployment of the payload 19. In such cases, the payload 19 may be of a weight too light (i.e., the loss of the payload's weight compared to the loss of volume is less than the needed weight of the remaining vehicle to substantially compensate for buoyancy according to Eq. 4) and may require additional items to be deployed at the same time with the payload 19. Furthermore, if the payload 19 is too heavy (i.e., the loss of the payload's mass compared to the loss of volume is greater than the needed weight of the remaining vehicle to substantially compensate for buoyancy according to Eq. 4), additional flotation devices may be stored in the system and deployed at deployment.

In some embodiments, the deployable payload 19 is of a heavier weight (i.e., heavier than the weight of the deployment chamber's wet space volume filled with fluid), and the chamber 12 is redesigned to encompass a larger volume of fluid than the volume of the payload 19, therefore reducing vehicle volume after deployment. In other embodiments, the deployable payload 19 is of a lighter weight (i.e., lighter than the weight of deployment chamber's wet space volume filled with fluid), and the chamber 12 is redesigned in such a way to accommodate a smaller volume of fluid than the volume of the payload 19, increasing the vehicle's volume after deployment.

The offset mechanism may compensate for the entire weight, volume, and/or density of each payload 19 deployed from the present invention, where certain circumstances exist wherein a partial ballast compensation is desired. In some embodiments, the offset mechanism only partially offsets the buoyancy change due to payload deployment, which allows the vehicle to change in buoyancy. Depending on the weight and volume of the payload 19 and the density of the fluid (as described above), the vehicle may be designed to become more or less buoyant over the course of deployment (especially multiple deployment events).

In the determination of the size and volume of the deployment chamber's wet space 18, a fluid displacement test may be employed to establish the amount of fluid displaced by the size of the payload 19, while also taking into account the density of the fluid in which the payload 19 is likely to be submerged in. Additionally, another aspect that must be taken into account is the density of the fluid of which is replacing the weight of the deployed payload 19 as seawater comprises a higher density than fresh water. As such, adjustments to the weight of the payload 19 or the volume of the wet space 18 may be made to accommodate any significant weight differences.

The vehicle may be brought back up to the surface and allowed to passively drain to remove the compensating fluid weight. In other embodiments, the compensating fluid weight is pumped out of the vehicle by a mechanical device (e.g., pump).

Example 1: Smart Breadcrumbs

In one example, the system 11 of the instant invention is incorporated into an AUV (i.e., the object 10), to drop guiding payloads for divers. The payloads of this example consist of acoustic waypoints, each having a small transducer, a transponder board and a receiver, similar to the components in the commercially available REMUS used for docking maneuvers. These payloads could be deployed along a desired path, to provide range and bearing to the diver HUD or tablet display indicating which direction the diver should go to get to the next payload marker. Payloads would be coded between at least 256 channels so that they can be followed in the correct sequence. The horizontal range is rated at 500 m and they are usually functional at 1000 m, and could be extended with known methods. Such a payload system could be utilized for very long and complicated tracks, as needed.

Example 2: Dynamically Deployed LBL Arrays

In another example, the system 11 is incorporated into an AUV (i.e., the object 10), to dynamically deploy on-demand communication and navigation arrays. Long Baseline (LBL) arrays are acoustic navigation infrastructure systems that facilitate the positioning and tracking of underwater vehicles and objects (e.g. marine animals). LBL systems have advantages over other similar systems, but have the disadvantage of requiring seal-floor mounted baseline transponders. In this example, a simple, affordable system deploys the LBL transponders from the deployment chambers 12, enabling the desired operations to commence without the current, expensive techniques. A vehicle containing the system would utilize its onboard positioning system (outside of the system 11) to mark the exact location of the deployed payloads, and would communicate those positions back to the user, enabling their use.

After reviewing the present disclosure, those skilled in the art will know or be able to ascertain using no more than routine experimentation, many equivalents to the embodiments and practices described herein. For example, several underwater vehicles such as remotely operated vehicles (ROVs) and unmanned underwater vehicles (UUVs), gliders, as well as submersibles carrying one or more humans, may be used with the systems and methods described herein. Accordingly, it will be understood that the systems and methods described are not to be limited to the embodiments disclosed herein, but is to be understood from the following claims, which are to be interpreted as broadly as allowed under the law.

Although specific features of the present invention are shown in some drawings and not in others, this is for convenience only, as each feature may be combined with any or all of the other features in accordance with the invention. While there have been shown, described, and pointed out fundamental novel features of the invention as applied to a preferred embodiment thereof, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps that perform substantially the same function, in substantially the same way, to achieve the same results be within the scope of the invention. Substitutions of elements from one described embodiment to another are also fully intended and contemplated. It is also to be understood that the drawings are not necessarily drawn to scale, but that they are merely conceptual in nature.

It is the intention, therefore, to be limited only as indicated by the scope of the claims appended hereto. Other embodiments will occur to those skilled in the art and are within the following claims.

Reference throughout this specification to "one embodiment," "an embodiment," or similar language means that a particular feature, structure, or characteristic described in connection with the embodiment is included in at least one embodiment. Thus appearances of the phrase "in one embodiment," "in an embodiment," and similar language throughout this specification may, but do not necessarily, all refer to the same embodiment.

We claim:

1. A system for payload deployment in a fluid environment, comprising:

a. at least one deployment chamber, configured to exclude the fluid environment, further comprising:

i. at least one inner wall defining a wet space, the wet space configured to be contiguous with and exposed to the fluid environment;

ii. at least one payload, said at least one payload comprising a first surface and a body housing, wherein the first surface is configured to comprise a portion of a sealing zone;

b. a vacuum mechanism connected to the wet space and configured to generate a vacuum force within the wet space;

c. a vacuum breaker connected to the wet space;

wherein the at least one payload is configured to fit at least partially within the wet space of the deployment chamber;

wherein the first surface is exposed to the fluid environment;

wherein the sealing zone forms a fluid-tight seal with a portion of the at least one inner wall, allowing the wet space to hold a vacuum;

wherein the at least one payload is held within the deployment chamber by the vacuum force; and wherein the vacuum breaker is configured to remove the vacuum force from the wet space.

2. The system of claim 1, wherein the at least one payload is held within the at least one deployment chamber solely by the vacuum force.

3. The system of claim 1, wherein the at least one inner wall, the vacuum mechanism, and the vacuum breaker and the at least one payload experience a first buoyant force and the at least one inner wall, the vacuum mechanism, and the vacuum breaker experience a second buoyant force, and wherein the second buoyant force does not differ more than 20 percent from said first buoyant force.

4. The system of claim 3, wherein the first buoyant force and second buoyant force are substantially equal.

5. The system of claim 1, wherein the wet space further comprises an offset mechanism.

6. The system of claim 5, wherein the at least one inner wall, the vacuum mechanism, the vacuum breaker, the offset mechanism, and the at least one payload-experience a third buoyant force, and wherein the third buoyant force does not differ more than 20 percent from the second buoyant force.

7. The system of claim 6, wherein the second buoyant force and third buoyant force are substantially equal.

8. A payload for use in fluid environments, comprising:

at least one surface; and a sealing zone;

wherein a portion of the payload is configured to fit into a deployment system, comprising a deployment chamber;

wherein the sealing zone is configured to form a vacuum seal with a portion of the deployment system;

wherein the deployment system is configured to generate a vacuum force; and wherein the payload is held within the deployment system by the vacuum force.

9. The payload of claim 8, wherein payload is held within the deployment chamber solely by the vacuum force.

10. The payload of claim 8, wherein the payload has a height to width ratio of 2.5 to 1.

11. The payload of claim 8, wherein the payload comprises functionality of at least one member of a group comprising: mine marking, storing an object, detecting electromagnetic signals, emitting electromagnetic signals, measuring a parameter of the fluid environment, receiving and relaying communications signals, guiding individuals, and mixtures thereof.

12. The payload of claim 8, wherein the sealing zone further comprises an O-ring.

13. The payload of claim 8, wherein the payload further comprises payload electronics, and a power source.

14. The payload of claim 8 further comprising:

a leg assembly, comprising at least one leg;

at least one leg attachment point;

a leg release mechanism;

wherein the at least one leg is connected to the payload at the at least one leg attachment point; and wherein the leg assembly is configured to be in at least a first position and a second position and the leg release mechanism is configured to enable transition between the first position and the second position.

15. The payload of claim 14, wherein the leg assembly is further configured to enable transition between the first position and the second position while the payload is resting on a surface.

16. A method for payload deployment in a fluid environment, comprising:

a. selecting a system comprising:

at least one deployment chamber;

a vacuum mechanism; and a vacuum breaker;

wherein the at least one deployment chamber is configured to exclude the fluid environment and comprises at least one inner wall;

wherein said at least one inner wall defines a wet space and said wet space is configured to be contiguous with and exposed to the fluid environment;

b. placing at least one payload into the at least one deployment chamber, the at least one payload comprising a first surface and a portion of a sealing zone; wherein a fluid-tight seal is formed between the sealing zone and a portion of the at least one inner wall;

c. using the vacuum mechanism to establish a vacuum in the wet space;

d. holding the at least one payload in the at least one deployment chamber solely by the vacuum force in the wet space;

e. placing the system in the fluid environment; and f. releasing the at least one payload.

17. The method of claim 16, wherein the vacuum breaker releases the at least one payload by allowing fluid to enter the wet space.

18. The method of claim 16, wherein the fluid environment comprises a fluid bottom, wherein upon payload release, the at least one payload drops through the fluid environment to the fluid bottom.

19. The method of claim 16, wherein the at least one payload further comprises at least one leg, at least one leg attachment point, and a leg release mechanism, wherein the each of the at least one leg is connect to the at least one payload at the at least one leg attachment point, wherein the at least one leg is configured to be in at least a first position and a second position and the leg release mechanism is configured to enable transition of the at least one leg between said first position and said second position.

20. The method of claim 19, wherein the at least one leg is further configured to enable transition between the first position and the second position while the at least one payload is on the fluid bottom.

21. The system of claim 1, wherein the at least one payload is water-tight having an internal space, and prevents entry of fluid into the internal space.

* * * * *